US010882340B2

(12) United States Patent
Orihara et al.

(10) Patent No.: US 10,882,340 B2
(45) Date of Patent: Jan. 5, 2021

(54) INK JET IMAGE FORMING METHOD AND INK JET IMAGE FORMING APPARATUS

(71) Applicant: CANON KABUSHIKI KAISHA, Tokyo (JP)

(72) Inventors: Tatsuaki Orihara, Tokyo (JP); Kenji Shinjo, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/713,342

(22) Filed: Dec. 13, 2019

(65) Prior Publication Data

US 2020/0114664 A1 Apr. 16, 2020

Related U.S. Application Data

(63) Continuation of application No. PCT/JP2018/024714, filed on Jun. 28, 2018.

(30) Foreign Application Priority Data

Jun. 30, 2017 (JP) ..... 2017-129728
Jun. 30, 2017 (JP) ..... 2017-129729

(51) Int. Cl.
*B41J 2/005* (2006.01)
*B41J 11/00* (2006.01)
*B41J 2/01* (2006.01)

(52) U.S. Cl.
CPC ..... *B41J 11/002* (2013.01); *B41J 2/0057* (2013.01); *B41J 2/01* (2013.01)

(58) Field of Classification Search
CPC ..... B41J 11/002; B41J 2/0057; B41J 2/01
See application file for complete search history.

(56) References Cited

U.S. PATENT DOCUMENTS

| | | | |
|---|---|---|---|
| 7,628,481 | B2 | 12/2009 | Kadomatsu et al. |
| 8,124,791 | B2 | 2/2012 | Shinjo et al. |
| 8,158,746 | B2 | 4/2012 | Shinjo |
| 8,408,690 | B2 | 4/2013 | Harada et al. |
| 8,940,373 | B2 | 1/2015 | Shinjo et al. |
| 9,051,484 | B2 | 6/2015 | Shinjo et al. |
| 10,384,470 | B2 | 8/2019 | Yamane et al. |

(Continued)

FOREIGN PATENT DOCUMENTS

| | | |
|---|---|---|
| JP | 2007-136811 A | 6/2007 |
| JP | 2009-45851 A | 3/2009 |

(Continued)

OTHER PUBLICATIONS

International Search Report in International Application No. PCT/JP2018/024714 (dated Aug. 2018).

(Continued)

*Primary Examiner* — Yaovi M Ameh
(74) *Attorney, Agent, or Firm* — Venable LLP

(57) ABSTRACT

Provided are an ink jet image forming method and an ink jet image forming apparatus in which a complex elastic modulus (Pa) before an intermediate image comes into contact with a liquid absorbing member is 4.0 or more in the common logarithm, and a complex elastic modulus (Pa) before the intermediate image comes into contact with the recording medium is 7.0 or less in the common logarithm.

16 Claims, 3 Drawing Sheets

(56) References Cited

U.S. PATENT DOCUMENTS

| | | | | |
|---|---|---|---|---|
| 10,543,705 | B2 | 1/2020 | Ohnishi et al. | |
| 2007/0166085 | A1* | 7/2007 | Shinshi | G03G 15/2057 399/329 |
| 2008/0074462 | A1* | 3/2008 | Hirakawa | B41J 2/2114 347/28 |
| 2009/0087211 | A1* | 4/2009 | Kadomatsu | G03G 15/11 399/99 |
| 2009/0286001 | A1 | 11/2009 | Kanke et al. | |
| 2011/0104453 | A1 | 5/2011 | Shinjo et al. | |
| 2018/0304616 | A1 | 10/2018 | Honda et al. | |
| 2018/0304617 | A1 | 10/2018 | Ohnishi et al. | |
| 2018/0311951 | A1 | 11/2018 | Sakamoto et al. | |
| 2018/0319166 | A1 | 11/2018 | Yamane et al. | |
| 2018/0319188 | A1 | 11/2018 | Toyama et al. | |
| 2018/0319189 | A1 | 11/2018 | Ohnishi et al. | |
| 2018/0319190 | A1 | 11/2018 | Masuda et al. | |
| 2018/0326755 | A1 | 11/2018 | Ohnishi et al. | |

FOREIGN PATENT DOCUMENTS

| | | | |
|---|---|---|---|
| JP | 2009-226852 | A | 10/2009 |
| JP | 4714949 | B2 | 7/2011 |
| JP | 2011-224797 | A | 11/2011 |
| JP | 2012-86499 | A | 5/2012 |
| JP | 5008645 | A | 8/2012 |
| WO | 2017/119046 | A1 | 7/2017 |
| WO | 2019/004397 | A1 | 1/2019 |
| WO | 2019/004428 | A1 | 1/2019 |

OTHER PUBLICATIONS

JP 5008645, JP 2012-86499.

JP 4714949.

JP 4714949, U.S. Pat. No. 7,628,481 B2.

WO 2017/119046, U.S. Pat. No. 10,384,470 B2 2018/0304616 A1 2018/0304617 A1 2018/0311951 A1 2018/0319166 A1 2018/0319188 A1 2018/0319189 A1 2018/0319190 A1 2018/0326755 A1.

Orihara et al., U.S. Appl. No. 16/722,801, filed Dec. 20, 2019.

International Preliminary Report on Patentability in International Application No. PCT/JP2018/024714 (Jan. 2020).

* cited by examiner

INK JET IMAGE FORMING METHOD AND INK JET IMAGE FORMING APPARATUS

CROSS-REFERENCE TO RELATED APPLICATIONS

This application is a Continuation of International Patent Application No. PCT/JP2018/024714, filed Jun. 28, 2018, which claims the benefit of Japanese Patent Applications No. 2017-129728, filed Jun. 30, 2017, and No. 2017-129729, filed Jun. 30, 2017, all of which are hereby incorporated by reference herein in their entirety.

BACKGROUND OF THE INVENTION

Field of the Invention

The present invention relates to an ink jet image forming method and an ink jet image forming apparatus.

Description of the Related Art

In a liquid image forming apparatus typified by an ink jet recording apparatus, a recording apparatus using an ink that is cured with active energy rays has been proposed and put into practical use. In general, the active energy rays used for curing are often ultraviolet rays. Since the ink undergoes a polymerization reaction by irradiation with ultraviolet rays to become a cured product, there is an advantage that a printed matter having high fastness can be obtained even immediately after printing. However, in many ultraviolet curable inks (hereinafter referred to as UV curable inks), all the ink components are cured by irradiation with ultraviolet rays, so a height of an image surface (thickness of an image) varies depending on the application amount of the ink, and therefore it is difficult to obtain an image with a flat surface. In addition, in order to eject the ink from an ink jet head, the ink needs to have a low viscosity. Therefore, it is necessary to contain a large amount of component having a low viscosity and being cured by irradiation with ultraviolet rays. However, the component that has a low viscosity and is cured by irradiation with ultraviolet rays has volatility, and there are problems such as the generation of odor, the environmental impact, or the like.

To solve the above problems, water-based UV curable inks containing water as a main component have been proposed. Since the main component is water, an image with a flat surface can be obtained, and the generation of odor and the environmental impact are also reduced.

However, as a general property of the water-based ink, there is a case where a recording medium absorbs moisture in the ink to cause curling or cockling.

The present inventors have proposed the following method as one of the methods for solving such problems of the water-based UV curable ink. That is, the present inventors propose a method for forming an intermediate image on a transfer body, and drying a liquid component contained in the intermediate image on the transfer body by blowing, heating, or the like, and then transferring the intermediate image to a recording medium such as paper (Japanese Patent No. 5008645 and Japanese Patent Application Laid-Open No. 2012-86499).

On the other hand, as a means to remove the liquid component from the water-based UV curable ink applied on the recording medium, a method for absorbing and removing a liquid component from an image by bringing a liquid absorbing member into contact with the image instead of drying by blowing, heating or the like has been proposed (Japanese Patent No. 4714949). Compared to drying by the blowing or the heating, by using a liquid absorbing member, it is possible to expect effects such as reducing energy required to remove the liquid component, shortening the processing time for removing the liquid component from the image, making a removal rate less dependent on the application amount of the ink, and the like.

However, in the method described in Japanese Patent No. 4714949, since the water-based UV curable ink is directly applied to the recording medium, the penetration of the liquid components into the recording medium is unavoidable, and therefore curling and cockling are still likely to occur. Further, it is found that when the liquid absorbing member described in Japanese Patent No. 4714949 is simply applied to a transfer type image forming apparatus such as Japanese Patent No. 5008645 and Japanese Patent Application Laid-Open No. 2012-86499, it is difficult to achieve the contradictory properties of satisfactorily transferring the intermediate image on the transfer body to the recording medium well without shifting the intermediate image to the liquid absorbing member.

The present invention has been made in view of the above problems. An object of the present invention is to provide an ink jet image forming method and an ink jet image forming apparatus capable of satisfactorily transferring an intermediate image to a recording medium while reducing the shift of the intermediate image to a liquid absorbing member.

SUMMARY OF THE INVENTION

The above object is achieved by the present invention described below.

An ink jet image forming method according to the present invention includes:

a first step of forming a first intermediate image by applying ink containing at least water and a component that is cured by irradiation with active energy rays to a transfer body;

a second step of forming a second intermediate image by irradiating the first intermediate image with active energy rays;

a third step of forming a third intermediate image by bringing a liquid absorbing member into contact with the second intermediate image to remove at least a part of liquid components contained in the second intermediate image; and a fourth step of forming an image on a recording medium by transferring the third intermediate image from the transfer body to the recording medium, wherein a complex elastic modulus (Pa) of the second intermediate image is 4.0 or more in a common logarithm, and a complex elastic modulus (Pa) of the third intermediate image is 7.0 or less in a common logarithm.

In addition, an ink jet image forming apparatus according to the present invention includes:

a transfer body;

an ink applying device that forms a first intermediate image by applying an ink containing at least water and a component that is cured by irradiation with active energy rays to the transfer body;

an active energy ray irradiating device that forms a second intermediate image by irradiating the first intermediate image with active energy rays;

a liquid absorbing device that forms a third intermediate image by bringing a liquid absorbing member into contact with the second intermediate image to remove at least a part of liquid components contained in the second intermediate image; and a transfer device that forms an image on a recording medium by transferring the third intermediate image from the transfer body to the recording medium, wherein a complex elastic modulus (Pa) of the second intermediate image is 4.0 or more in a common logarithm, and a complex elastic modulus (Pa) of the third intermediate image is 7.0 or less in a common logarithm.

Further features of the present invention will become apparent from the following description of exemplary embodiments with reference to the attached drawings.

DESCRIPTION OF THE EMBODIMENTS

Figure 1:
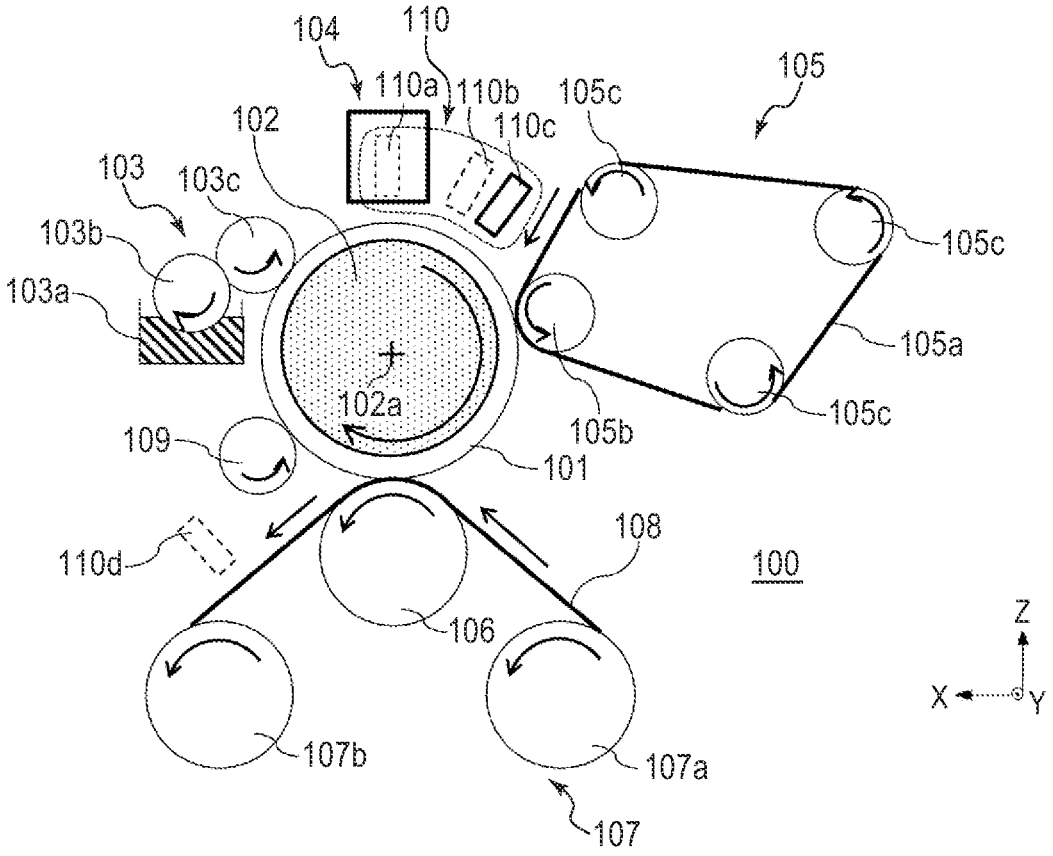
FIG. 1 is a schematic diagram showing an example of a configuration of a transfer type ink jet recording apparatus according to an embodiment of the present invention.

Hereinafter, an ink jet image forming method and an ink jet image forming apparatus according to the present invention will be described in detail by exemplifying an ink jet recording apparatus. However, configurations, structures, materials, settings, and the like can be appropriately changed according to various conditions to which the invention is applied, and are not intended to limit the scope of the present invention.

The ink jet recording apparatus according to the present invention is a transfer type ink jet recording apparatus (ink jet image forming apparatus) to which the ink jet image forming method according to the present invention is applied. The ink jet image forming method according to the present invention includes the following first to fourth steps, a complex elastic modulus (Pa) of a second intermediate image is 4.0 or more in the common logarithm, and a complex elastic modulus (Pa) of a third intermediate image is 7.0 or less in the common logarithm. Further, the ink jet image forming apparatus according to the present invention controls the complex elastic modulus (Pa) of the second intermediate image to be 4.0 or more in the common logarithm, and the complex elastic modulus (Pa) of the third intermediate image to be 7.0 or less in the common logarithm. For example, in the ink jet recording apparatus according to the present invention, this feature is achieved by making the active energy ray irradiating device and the liquid absorbing device have a function of setting the following conditions.

The complex elastic modulus (Pa) of the second intermediate image is set to be 4.0 or more in the common logarithm, and the complex elastic modulus (Pa) of the third intermediate image is set to be 7.0 or less.

(First Step)

It is a step of forming a first intermediate image by applying an ink containing at least water and a component that is cured by irradiation with active energy rays to a transfer body.

(Second Step)

It is a step of forming a second intermediate image by irradiating the first intermediate image with active energy rays.

(Third Step)

It is a step of forming a third intermediate image by bringing a liquid absorbing member into contact with the second intermediate image to remove at least a part of the liquid components contained in the second intermediate image.

(Fourth Step)

It is a step of forming an image on a recording medium by transferring the third intermediate image from the transfer body to the recording medium.

The transfer type ink jet recording apparatus according to an embodiment of the present invention will be described below with reference to the drawings. In the present invention, the ink jet recording apparatus for forming an ink image by ejecting ink to a transfer body as an ink receiving medium and transferring the ink image to a recording medium after a liquid absorbing member absorbs liquid from the ink image is referred to as a transfer type ink jet recording apparatus for convenience.

<Transfer Type Ink Jet Recording Apparatus>

FIG. 1 is a schematic diagram showing an example of a schematic configuration of a transfer type ink jet recording apparatus 100 according to the present embodiment. This recording apparatus is a sheet type ink jet recording apparatus for manufacturing a recorded matter by transferring an ink image to a recording medium 108 via a transfer body 101. According to the present embodiment, an X direction, a Y direction, and a Z direction each indicate a width direction (full length direction), a depth direction, and a height direction of the ink jet recording apparatus 100. The recording medium 108 is conveyed in the X direction.

As shown in FIG. 1, the transfer type ink jet recording apparatus 100 according to the present embodiment includes the following members or devices.

- A support member 102 and a transfer body 101 supported by the support member 102.
- An ink applying device 104 including an ink jet head that applies ink to the transfer body 101 to form a first intermediate image.
- An ultraviolet ray irradiating device 110 that is an active energy ray irradiating device forming a second intermediate image by irradiating the first intermediate image with ultraviolet rays that are active energy rays.
- A liquid absorbing device 105 that forms a third intermediate image by removing at least a part of liquid components contained in the second intermediate image on the transfer body 101.
- A transfer device that includes a transfer pressing member 106 for forming an image by transferring the third intermediate image on the transfer body 101 from which the liquid components are removed to the recording medium 108 such as paper.

The transfer type ink jet recording apparatus 100 may also include a reaction liquid applying device 103 that applies a reaction liquid reacting with ink to the transfer body 101 as necessary. The transfer type ink jet recording apparatus 100 may also include a transfer body cleaning member 109 that cleans a surface of the transfer body 101 after the transfer. Naturally, each of the following members or devices has a length, which corresponds to the recording medium 108 to be used, in the Y direction.

Transfer body 101

Reaction liquid applying device 103

Ink jet head of ink applying device 104

Liquid absorbing device 105

Transfer body cleaning member 109

Pressing member 106

The transfer body 101 rotates around a rotation shaft 102*a* of the support member 102 in a direction of an arrow in FIG. 1. The transfer body 101 moves by the rotation of the support member 102. If necessary, the reaction liquid by the reaction liquid applying device 103 and the ink by the ink applying device 104 are sequentially applied to the moving transfer body 101 to form the first intermediate image that is the ink image on the transfer body 101. The first intermediate image formed on the transfer body 101 is irradiated with ultraviolet rays by the ultraviolet ray irradiating device 110 to become a second intermediate image, and then moves to a position contacting the liquid absorbing member 105*a* included in the liquid absorbing device 105 by the movement of the transfer body 101.

The transfer body 101 and the liquid absorbing device 105 move in synchronization with the rotation of the transfer body 101. The second intermediate image formed on the transfer body 101 undergoes contact with the moving liquid absorbing member 105*a*. During this state, the liquid absorbing member 105*a* forms a third intermediate image by removing at least a part of the liquid components contained in the second intermediate image on the transfer body.

Describing the removal of liquid components from a different viewpoint, it can also be expressed as concentrating the ink constituting the second intermediate image formed on the transfer body 101. The concentration of the ink means that a content ratio of a solid content such as a coloring material or a resin contained in the ink with respect to the liquid components increases by reducing the liquid components included in the ink.

Then, the third intermediate image, which is an intermediate image after the removal of liquid from which the liquid components are removed, is in a state where the ink is more concentrated than the second intermediate image which is the intermediate image before the removal of liquid, and furthermore moves to a transfer portion contacting the recording medium 108, which is conveyed by a recording medium conveying device 107, by the transfer body 101. While the third intermediate image after the removal of liquid is in contact with the recording medium 108, the pressing member 106 presses the transfer body 101 to transfer an image to the recording medium 108. The transferred image transferred to the recording medium 108 is a reverse image of the second intermediate image before the removal of liquid and the third intermediate image after the removal of liquid.

In the present embodiment, since the reaction liquid is preferably applied to the transfer body 101 and then the ink is applied to form the intermediate image, the reaction liquid remains in a non-image area where the intermediate image is not formed by the ink without reacting with the ink. In this apparatus, the liquid absorbing member 105*a* contacts not only the intermediate image but also the unreacted reaction liquid, and also removes the liquid components of the reaction liquid.

Therefore, in the above description, it is expressed that the liquid components are removed from the intermediate image. However, the above expression does not restrictively mean that the liquid components are removed only from the intermediate image, and means that the liquid components are removed from at least the intermediate image on the transfer body 101.

The liquid components are not particularly limited as long as they do not have a certain shape, has fluidity, and have a substantially constant volume.

For example, water, an organic solvent, or the like contained in an ink or a reaction liquid can be used as the liquid component.

Each configuration of the transfer type ink jet recording apparatus according to the present embodiment will be described below.

<Transfer Body>

The transfer body 101 preferably has a surface layer including an image forming surface. As a material for the surface layer, various materials such as a resin and a ceramic can be used as appropriate, but a material having a high compression elastic modulus is preferable in terms of durability and the like. Specific examples of the materials include acrylic resins, acrylic silicone resins, fluorine-containing resins, condensates obtained by condensing hydrolyzable organosilicon compounds, and the like. In order to improve the wettability and transferability of the reaction liquid, surface treatment may be performed. Examples of the surface treatment include flame treatment, corona treatment, plasma treatment, polishing treatment, roughening treatment, active energy ray irradiation treatment, ozone treatment, surfactant treatment, and silane coupling treatment. Combinations of a plurality of these treatments may be preferred. In addition, arbitrary surface shapes can also be provided on the surface layer.

In addition, the transfer body preferably has a compression layer having a function of absorbing pressure fluctuation. By providing the compression layer, the compression layer can absorb deformation, disperse the fluctuation with respect to the local pressure fluctuation, and maintain good transferability even during high-speed printing. Examples of the materials for the compression layer include acrylonitrile-butadiene rubber, acrylic rubber, chloroprene rubber, urethane rubber, silicone rubber, and the like. During molding the rubber material, a predetermined amount of a vulcanizing agent, a vulcanization accelerator, and the like are blended, and fillers such as a foaming agent, hollow fine particles, or salt are blended as necessary, such that the rubber material is preferably porous. As a result, bubble parts are compressed with a volume change against various pressure fluctuations, such that the deformation in the direction other than the compression direction is small and more stable transferability and durability can be obtained. As the porous rubber material, there are a material having a continuous pore structure in which each pore is continuous with each other and a material having an independent pore structure in which each pore is independent from each other. In the present invention, any structure may be used, and these structures may be used in combination.

Further, the transfer body preferably has an elastic layer between the surface layer and the compression layer. As the material for the elastic layer, various materials such as a resin and ceramic can be used as appropriate. Various elastomer materials and rubber materials are preferably used in terms of processing characteristics and the like. Specific examples of the materials include fluorosilicone rubber, phenyl silicone rubber, fluoro rubber, chloroprene rubber, urethane rubber, nitrile rubber, ethylene propylene rubber, natural rubber, styrene rubber, isoprene rubber, butadiene rubber, an ethylene/propylene/butadiene copolymer, nitrile butadiene rubber, and the like. In particular, the silicone rubber, the fluorosilicone rubber, and the phenyl silicone rubber are preferable in terms of dimensional stability and durability because they have a small compression set. Further, the change in elastic modulus with temperature is small, which is preferable in terms of transferability.

Various adhesives or double-sided tapes may be used between each layer (surface layer, elastic layer, compression layer) constituting the transfer body in order to fix and maintain these layers. In addition, a reinforcing layer having a high compression elastic modulus may be provided in order to suppress lateral elongation at the time of mounting on the apparatus or to maintain firmness. In addition, a woven fabric may be used as the reinforcing layer. The transfer body can be produced by arbitrarily combining the layers made of the above materials.

The size of the transfer body can be freely selected according to the target print image size. The shape of the transfer body is not particularly limited, and specific examples thereof include a sheet shape, a roller shape, a belt shape, an endless web shape, and the like.

<Support Member>

The transfer body 101 is supported on a support member 102. As the method for supporting the transfer body 101, various adhesives or double-sided tapes may be used. Alternatively, the transfer body 101 may be supported on the support member 102 using an installation member by attaching the installation member made of a metal, a ceramic, a resin, or the like to the transfer body.

The support member 102 is required to have a certain degree of structural strength from the viewpoint of the conveyance accuracy and the durability. As the material of the support member, a metal, a ceramic, a resin or the like is preferably used. In particular, in addition to rigidity and dimensional accuracy that can withstand pressure during the transfer, to reduce control inertia during the operation and improve control responsiveness, aluminum, iron, stainless steel, an acetal resin, an epoxy resin, polyimide, polyethylene, polyethylene terephthalate, nylon, polyurethane, silica ceramics, and alumina ceramics are preferably used. In addition, it is also preferable to use combinations of these.

<Reaction Liquid Applying Device>

The ink jet recording apparatus according to the present embodiment preferably includes the reaction liquid applying device 103 that applies the reaction liquid to the transfer body 101. When the reaction liquid comes into contact with the ink, the fluidity of the ink and/or a part of the ink composition on the transfer body (also referred to as an ink receiving medium) is lowered, and bleeding or beading during the image formation with the ink can be suppressed. Specifically, a reactant (also referred to as an ink thickening component) contained in the reaction liquid chemically reacts by coming into contact with a color material, a resin or the like that is a part of the composition constituting the ink or is physically adsorbed. As a result, it is possible to cause an increase in the viscosity of the entire ink, a local increase in viscosity due to agglomeration of a part of the components constituting the ink such as the color material, and lower the fluidity of the ink and/or a part of the ink composition. As the reaction liquid applying device 103 in FIG. 1, there may be a gravure offset roller which has a reaction liquid storage part 103*a* storing the reaction liquid, and reaction liquid applying members 103*b* and 103*c* applying the reaction liquid in the reaction liquid storage part 103*a* to the transfer body 101.

The reaction liquid applying device 103 may be any device that can apply the reaction liquid to the ink receiving medium, and various known devices can be used as appropriate. Specific examples of the known devices include a gravure offset roller, an ink jet head, a die coating device (die coater), a blade coating device (blade coater), and the like.

The application of the reaction liquid by the reaction liquid applying device 103 may be performed before or after applying the ink as long as the reaction liquid can be mixed (react) with the ink on the ink receiving medium. Preferably, the reaction liquid is applied before applying the ink. By applying the reaction liquid before applying the ink, the bleeding in which adjacently applied inks are mixed together, or the beading in which the ink landed first is drawn to the ink landed later can be suppressed during the image recording by the ink jet method.

<Reaction Liquid>

Hereinafter, each component which constitutes the reaction liquid applied to the present embodiment will be described in detail.

(Reactant)

The reaction liquid agglomerates components (resin, self-dispersing pigment, and the like) having an anionic group in the ink by coming into contact with the ink, and contains a reactant. Examples of the reactant include polyvalent metal ions, cationic components such as cationic resins, and organic acids.

Examples of the polyvalent metal ions include divalent metal ions such as $Ca^{2+}$, $Cu^{2+}$, $Ni^{2+}$, $Mg^{2+}$, $Sr^{2+}$, $Ba^{2+}$, and $Zn^{2+}$, trivalent metal ions such as $Fe^{3+}$, $Cr^{3+}$, $Y^{3+}$, and $Al^{3+}$ and the like. In order to make the reaction liquid contain the polyvalent metal ions, a polyvalent metal salt (which may be a hydrate) constituted by combining the polyvalent metal ion with anions can be used. Examples of the anions include inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$, and $H_2PO_4$; organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$, and $CH_3SO_3^-$, and the like. When the polyvalent metal ion is used as the reactant, the content (% by mass) in terms of the polyvalent metal salt in the reaction liquid is preferably 1.00% by mass or more and 20.00% by mass or less based on the total mass of the reaction liquid.

The reaction liquid containing an organic acid has a buffering ability in an acidic region (less than pH 7.0, preferably pH 2.0 to 5.0), such that an anionic group of a component present in the ink agglomerates in an acid form. Examples of the organic acid include monocarboxylic acids such as formic acid, acetic acid, propionic acid, butyric acid, benzoic acid, glycolic acid, lactic acid, salicylic acid, pyrrole carboxylic acid, furan carboxylic acid, picolinic acid, nicotinic acid, thiophene carboxylic acid, levulinic acid, and coumaric acid, and salts thereof; dicarboxylic acids such as oxalic acid, malonic acid, succinic acid, glutaric acid, adipic acid, maleic acid, fumaric acid, itaconic acid, sebacic acid, phthalic acid, malic acid, and tartaric acid, and salts or hydrogen salts thereof; tricarboxylic acids such as citric acid and trimellitic acid, and salts or hydrogen salts thereof; tetracarboxylic acids such as pyromellitic acid, and salts or hydrogen salts thereof, and the like. Among these, a hydroxy acid is preferable from the viewpoint of transferability and blocking resistance. The content (% by mass) of the organic acid in the reaction liquid is preferably 1.00% by mass or more and 50.00% by mass or less.

Examples of the cationic resin include a resin having a primary to tertiary amine structure, a resin having a quaternary ammonium salt structure, and the like. Specific examples of the cation resin may include resins having a structure such as vinylamine, allylamine, vinylimidazole, vinylpyridine, dimethylaminoethyl methacrylate, ethyleneimine, and guanidine. In order to enhance the solubility in the reaction liquid, the cationic resin and the acidic compound can be used in combination, or a quaternization treatment of the cationic resin can be performed. When the cationic resin is used as the reactant, the content (% by mass) of the cationic resin in the reaction liquid is preferably 1.00% by mass or more and 10.00% by mass or less based on the total mass of the reaction liquid.

(Component Other than Reactant)

As components other than the reactants, an aqueous medium described later as one that can be used in the ink, the same those as other additives, and the like can be used.

<Ink Applying Device>

The ink jet recording apparatus according to the present embodiment includes ink applying device 104 that applies the ink to the transfer body 101. The ink applying device is a device that can perform a first step, that is, a step of forming a first intermediate image by applying an ink containing at least water and a component that is cured by irradiation with active energy rays to a transfer body. The first intermediate image that is an ink image is formed on the transfer body 101 by the ink. When the reaction liquid is applied on the transfer body, the reaction liquid and the ink are mixed, and the first intermediate image that is an ink image is formed by the reaction liquid and the ink.

In the present embodiment, an ink jet head is used as an ink applying device that applies an ink. Examples of the ink jet head include a form in which the ink is ejected by causing film boiling to form bubbles in the ink by an electro-thermal converter, a form in which the ink is ejected by an electro-mechanical converter, a form in which the ink is ejected using static electricity, and the like. In the present embodiment, the known ink jet head can be used. In particular, those using an electro-thermal converter are preferably used from the viewpoint of high-speed and high-density printing. A drawing receives an image signal and a necessary ink amount is applied to each position.

In the present embodiment, the ink jet head is a full line head extending in the Y direction, and nozzles are arranged within a range that covers a width of an image recording area of a maximum-size recording medium that can be used. The ink jet head has an ink ejection surface on which nozzles are open on a lower surface (transfer body 101 side) thereof, and the ink ejection surface faces the surface of the transfer body 101 with a minute gap (about several millimeters).

The ink applying device 104 may have a plurality of ink jet heads in order to apply color inks of each color to the ink receiving medium. For example, when forming each color image using yellow ink, magenta ink, cyan ink, and black ink, the ink applying device has four ink jet heads that eject the above four types of ink to an ink receiving medium. These are arranged in the X direction.

Further, the ink applying device 104 does not contain a color material or contains the color material at a very low ratio even if it contains the color material, and may include an ink jet head that ejects substantially transparent clear ink. The clear ink can be used together with the reaction liquid and the color ink to form an ink image. For example, this clear ink can be used to improve glossiness of an image. The resin component to be blended is appropriately adjusted so that the image after the transfer has a glossy feeling, and furthermore, the ejection position of the clear ink may be controlled. Since it is preferable that the clear ink is on the surface layer side than the color ink in a final recorded matter, in the transfer body type recording apparatus, the clear ink is applied to the transfer body 101 followed by applying the color ink to the transfer body 101. Therefore, the ink jet head for the clear ink can be arranged on an upstream side of the ink jet head for the color ink in a moving direction of the transfer body 101 facing the ink applying device 104.

Further, the clear ink can be used for improving the transferability of the image from the transfer body 101 to the recording medium, not for the glossiness. For example, the clear ink contains more components that exhibit adhesiveness than the color ink, and by applying the components to the color ink, the clear ink can be used as a transferability improving liquid to be applied to the transfer body 101. For example, in the moving direction of the transfer body 101 facing the ink applying device 104, the ink jet head for the clear ink for improving transferability is arranged on a downstream side of the ink jet head for the color ink. After the color ink is applied to the transfer body 101, the clear ink is applied to the transfer body 101 after the color ink is applied, so that the clear ink exists on an outermost surface of the ink image. In the transfer of the ink image to the recording medium in the transfer device, the clear ink on the surface of the ink image adheres to the recording medium 108 with a certain degree of adhesive force, so that the ink image after the removal of liquid tends to move to the recording medium 108.

<Water-Based Active Energy Ray Curable Ink>

As the ink according to the present embodiment, ink containing at least water and a component that is cured by irradiation with active energy rays is used. Hereinafter, the ink used when ultraviolet rays (UV) are used as active energy rays may be referred to as water-based UV curable ink.

(Hydrophilic Polymerizable Component)

The component that is cured by irradiation with active energy rays is not particularly limited, but for example, ultraviolet curable resins and the like are used. Many UV curable resins are insoluble in water, but as a material that can be applied to the water-based ink suitably used in the present invention, the structure preferably has an ethylenically unsaturated bond that can be cured by UV rays and has a hydrophilic linking group. Examples of the linking group having hydrophilicity include a hydroxyl group, a carboxyl group, a phosphoric acid group, and a sulfonic acid group, and salts thereof, an ether bond, an amide bond, and the like.

The component that is cured by irradiation with active energy rays used in the present invention is preferably hydrophilic (hereinafter referred to as a hydrophilic polymerizable component). The compound (polymerizable compound) that is a polymerizable component here is hydrophilic, which means that the compound is in any of the following states (1) to (3).

(1) The polymerizable compound is soluble in an organic solvent miscible with water, and the organic solvent solution is water-soluble.

(2) The polymerizable compound itself is treated in a form that can be emulsified in water even if it is water-insoluble.

(3) The polymerizable compound is water-soluble.

As to the State of Above (1)

Examples of the organic solvent miscible with water in the present invention include polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether, glycerin, 2-pyrrolidone, and the like.

As to the State of Above (2)

In the present invention, even if the polymerizable compound itself is water-insoluble, the polymerizable compound can be applied to an aqueous ink in the form of an emulsion or dispersion by treating the polymerizable compound in the form that can be emulsified in water. Examples of the treatment method include a method for emulsifying and dispersing a polymerizable compound with a surfactant and the like, and applying a hydrophilic group such as a dispersible anionic group to a structure of the polymerizable compound. Examples of commercially available products that undergo such treatment include BEAMSET EM-90 and BEAMSET EM-92 (manufactured by ARAKAWA CHEMICAL INDUSTRIES, LTD.), and UA-7100 and UA-W2 (manufactured by Shin Nakamura Chemical Co., Ltd).

As to the State of Above (3)

In the present invention, at least one of the hydrophilic polymerizable components is preferably water-soluble. Further, the hydrophilic polymerizable component is more preferably liquid at normal temperature. In addition, the hydrophilic polymerizable component is preferably a radical polymerizable substance. The hydrophilic polymerizable component more preferably has a (meth) acrylamide structure. The hydrophilic polymerizable component may also be contained in the reaction solution. Preferred examples of the hydrophilic polymerizable components are shown in Table 1 below.

TABLE 1

| Example No. | Structural Formula |
|---|---|
| 1 | 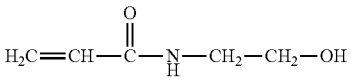 |
| 2 | 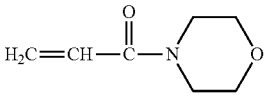 |
| 3 | 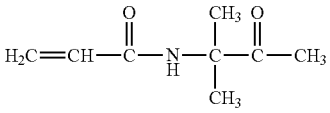 |
| 4 | 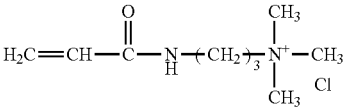 |
| 5 | 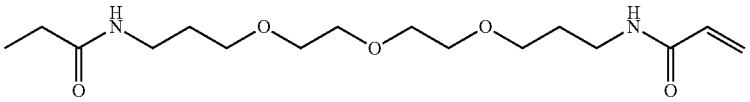 |
| 6 | 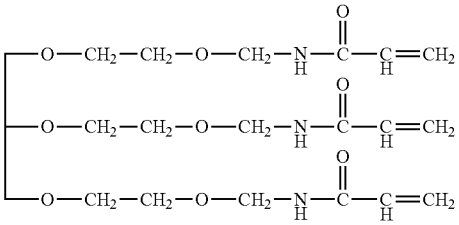 |
| 7 | 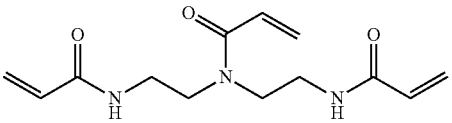 |
| 8 | 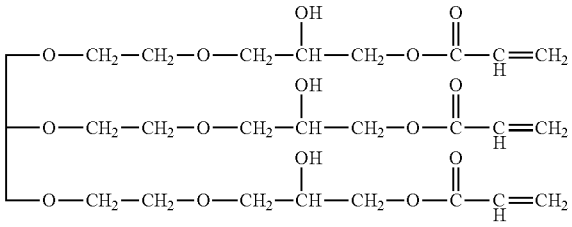 |

TABLE 1-continued

| Example No. | Structural Formula |
|---|---|
| 9 | 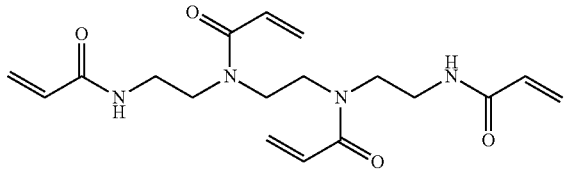 |
| 10 | 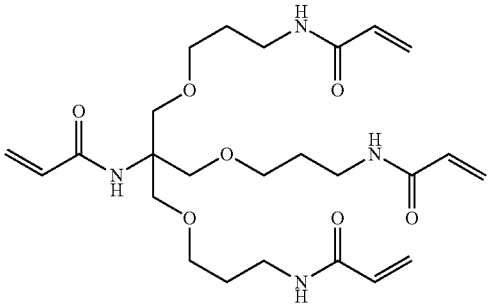 |
| 11 | 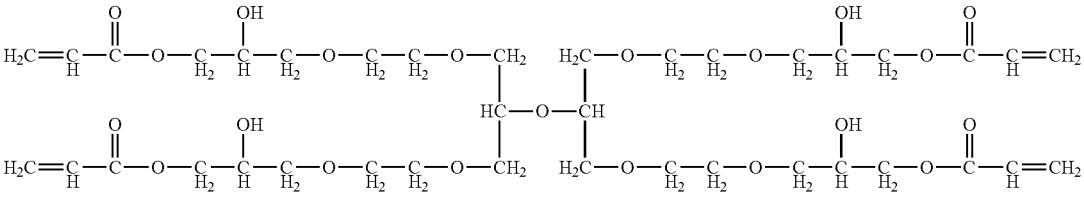 |
| 12 | 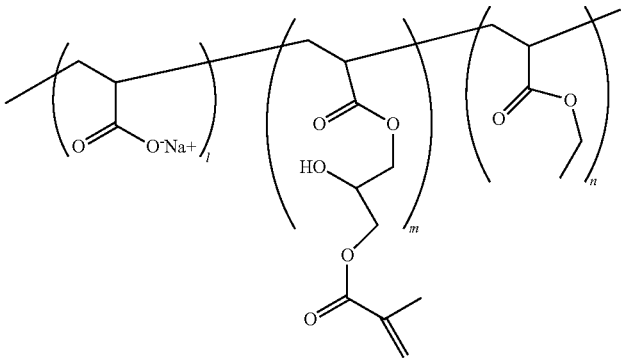 <br>Ratio of m m/(l + m + n) = 40%<br>Ratio of l l/(l + m + n) = 40%<br>Average molecular weight: About 35000 |
| 13 | 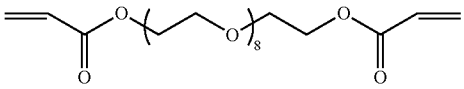 <br>Average molecular weight: 400 |

(Hydrophilic Polymerization Initiator)

The polymerization initiator used in the present invention is preferably hydrophilic. When the hydrophilic polymerizable component is a radical polymerizable substance, the hydrophilic polymerization initiator may be any compound that generates radicals by the active energy rays. Among the hydrophilic polymerization initiators, from the viewpoint of water solubility, at least one compound selected from the group consisting of the following General Formulas (2) and (4) to (7) is preferable.

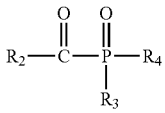

(2)

In the above formula, $R_2$ represents an alkyl group or a phenyl group, $R_3$ represents an alkyloxy group or a phenyl group, and $R_4$ represents a group represented by the following General Formula (3).

(3)

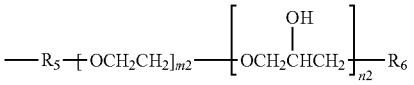

In the above formula, $R_5$ represents —$[CH_2]_{x2}$— (x2 is 0 or 1) or a phenylene group, m2 represents an integer of 0 to 10, n2 represents 0 or 1, and $R_6$ represents a hydrogen atom, a sulfone group, a carboxyl group, a hydroxyl group, or a salt thereof.

(4)

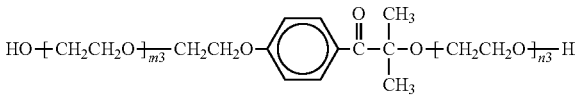

In the above formula, m3 represents an integer of 1 or more, n3 represents an integer of 0 or more, and m3+n3 represents an integer of 1 to 8.

(5)

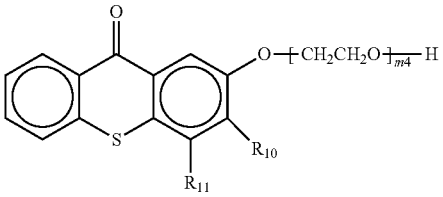

In the above formula, $R_{10}$ and $R_{11}$ each independently represent a hydrogen atom or an alkyl group, and m4 represents an integer of 5 to 10.

(6)

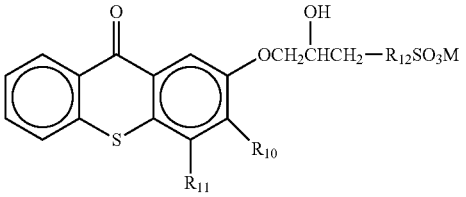

In the above formula, $R_{10}$ and $R_{11}$ each independently represents a hydrogen atom or an alkyl group, and $R_{12}$ represents —$(CH_2)_x$— (x is 0 or 1), —O—$(CH_2)_y$— (y is 1 or 2), or a phenylene group.

(7)

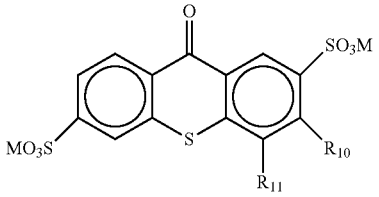

In the above formula, $R_{10}$ and $R_{11}$ each independently represent a hydrogen atom or an alkyl group.

In the General Formulas (6) and (7), M are each independently a hydrogen atom, an alkali metal forming a salt, an alkaline earth metal, or ammonium represented by $HNR_7R_8R_9$ ($R_7$, $R_8$, and $R_9$ each independently represent a hydrogen atom, a lower alkyl group having 1 to 5 carbon atoms, a monohydroxyl-substituted lower alkyl group having 1 to 5 carbon atoms, or a phenyl group).

Among these, from the viewpoint of low odor, UV-LED correspondence, or the like, the compounds represented by the General Formulas (2), (4) and (5) are preferable, and in particular, the compounds represented by the General Formulas (2) and (4) are preferable.

The alkyl group and the phenyl group represented by $R_2$ in the General Formula (2) may have a substituent. Examples of the substituent include the following. Specific examples of the substituent include halogen, a lower alkyl group having 1 to 5 carbon atoms, a lower alkyloxy group having 1 to 5 carbon atoms, a group represented by the above General Formula (3), a sulfone group, a carboxyl group, and a hydroxyl group. Particularly preferred $R_2$ is a phenyl group having a lower alkyl group having 1 to 5 carbon atoms as a substituent.

The phenylene group represented by $R_5$ in the General Formula (3) may have a substituent. Examples of the substituent include the following. Specific examples of the substituent include halogen, a lower alkyl group having 1 to 5 carbon atoms, a lower alkyloxy group having 1 to 5 carbon atoms, a sulfone group, a carboxyl group, and a hydroxyl group.

When the phenyl group of $R_2$ in the General Formula (2) and the phenylene group of $R_5$ in the General Formula (3) have a sulfone group, a carboxyl group, or a hydroxyl group as a substituent, a salt may be formed. That is, it can be represented by —$SO_3M$, —$CO_2M$ and —OM. In addition, when $R_6$ in the General Formula (3) is a sulfone group, a carboxyl group, or a hydroxyl group, it can also be represented by —$SO_3M$, —$CO_2M$ and —OM. Such M is defined in the same manner as M in the General Formulas (6) and (7).

The alkyloxy group and the phenyl group represented by $R_3$ in the General Formula (2) may have a substituent, and examples of the substituent include halogen, a lower alkyl group having 1 to 5 carbon atoms, and a lower alkyloxy group having 1 to 5 carbon atoms. Particularly preferred $R_3$ is an alkyloxy group, and among these, is —$OC_2H_5$ and $OC(CH_3)_3$.

The alkyl group represented by $R_{10}$ and $R_{11}$ in the General Formulas (5) to (7) may have a substituent. Examples of the substituent include the following. Specific examples of the substituent include halogen, a sulfone group, a carboxyl group, and a hydroxyl group.

Particularly preferred specific examples of these hydrophilic polymerization initiators include hydrophilic polymerization initiators having structures shown in Table 2 below, but the hydrophilic polymerization initiators used in the present invention are not limited thereto.

TABLE 2

| Exemplified Compound No. | Structural Formula |
|---|---|
| PI-1 | 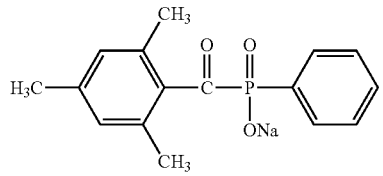 |
| PI-2 | 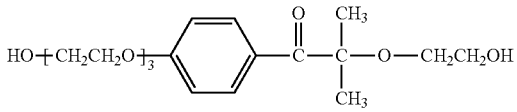 |
| PI-3 | 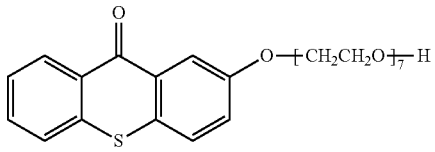 |
| PI-4 | 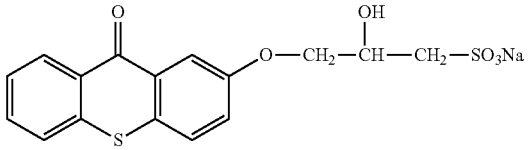 |
| PI-5 | 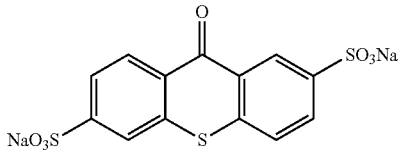 |

When a thioxanthone-based hydrophilic polymerization initiator or the like is used as the hydrophilic polymerization initiator, it is preferable to add a hydrogen donor. Examples of the hydrogen donor include triethanolamine and monoethanolamine, but are not limited to.

In addition, two or more kinds of hydrophilic polymerization initiators can be used in combination. By adding two or more kinds of hydrophilic polymerization initiators, a generation of further radicals can be expected using light having a wavelength that cannot be effectively used with one kind of hydrophilic polymerization initiator. Further, the hydrophilic polymerization initiator as described above is not always necessary for a case of an electron beam curing method of curing ink using an electron beam as an active energy ray.

Moreover, the component that is cured by the irradiation with the active energy rays may be used in combination with an active energy ray curing catalyst. Such a curing catalyst preferably has a skeleton such as α-hydroxyketone, benzyl ketal, acylphosphine, and thioxanthone, and has hydrophilicity in order to maximize the reactivity. Examples of the linking group having hydrophilicity include a hydroxyl group, a carboxyl group, a phosphoric acid group, and a sulfonic acid group, and salts thereof, an ether bond, an amide bond, and the like, and any of these can be preferably used. The material used in the present invention is preferably dissolved in water by 1% by mass or more.

Furthermore, it is one of preferable modes to use a sensitizer having a role of extending an absorption wavelength of light in order to improve a reaction rate.

The ink used is not particularly limited except that it contains a color material and a polymerizable component (preferably a hydrophilic polymerizable component). In some cases, it may be used as a transparent ink without a colorant. In general, dyes, pigments, and dispersions thereof are preferably used as the color material.

The dye is not limited, and any commonly used dye can be used without any problem. Examples of the dye include C.I direct blue 6, 8, 22, 34, 70, 71, 76, 78, 86, 142, and 199; C.I acid blue 9, 22, 40, 59, 93, 102, 104, 117, 120, 167, and 229; C.I direct red 1, 4, 17, 28, 83, and 227; C.I acid red 1, 4, 8, 13, 14, 15, 18, 21, 26, 35, 37, 249, 257, and 289; C.I direct yellow 12, 24, 26, 86, 98, 132, and 142; C.I acid yellow 1, 3, 4, 7, 11, 12, 13, 14, 19, 23, 25, 34, 44, and 71; C.I food black 1 and 2; C.I acid black 2, 7, 24, 26, 31, 52, 112, and 118, and the like.

The pigment is not limited, and any commonly used pigment can be used without any problem. Examples of the pigment include C.I pigment blue 1, 2, 3, 15:3, 16, and 22; C.I pigment red 5, 7, 12, 48 (Ca), 48 (Mn), 57 (Ca), 112, and 122; C.I pigment yellow 1, 2, 3, 13, 16, and 83; carbon black No. 2300, 900, 33, 40, and 52; MA7, 8, and MCF88 (manufactured by Mitsubishi Kasei Corporation); RAVEN1255 (manufactured by Columbian Chemicals Company); REGAL330R, 660R and MOGUL (manufactured by Cabot Corporation); Color Black FW1, FW18, S170, S150, and Printex35 (manufactured by Degussa AG), and the like.

As the dispersion resin capable of dispersing the dye and the pigment, those having water solubility and a weight average molecular weight of about 1000 to 15000 are preferably used. Examples of the dispersion resin include block copolymers or random copolymers composed of the following monomers, and salts thereof.

Styrene and derivatives thereof
Vinylnaphthalene and derivatives thereof
Aliphatic alcohol ester of α,β-ethylenically unsaturated carboxylic acid
Acrylic acid and derivatives thereof
Maleic acid and derivatives thereof
Itaconic acid and derivatives thereof
Fumaric acid and derivatives thereof.

Moreover, a photocurable resin can also be used alone without using the dispersion resin. Further, the present invention is not limited as an ink form, and a self-dispersion type, a resin dispersion type, a microcapsule type, or the like can be used as appropriate.

The ink may contain an organic solvent in order to control ink jet ejection properties or drying properties. The organic solvent to be used is preferably a water-soluble material having a high boiling point and a low vapor pressure. Examples of the organic solvent include polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether, glycerin, and the like. In addition, alcohols such as ethyl alcohol and isopropyl alcohol and various surfactants can be added as components for adjusting viscosity, surface tension, and the like.

The blending ratio of each component in the ink is not limited, and can be adjusted within a range that can be ejected from the selected ink jet recording method, an ejection output of the head, a nozzle diameter, and the like. In general, the ink contains 0.1 to 10% by mass of a color material, 0.1 to 10% by mass of a dispersion resin, 3 to 40% by mass of a hydrophilic polymerizable component, 0 to 10% by mass of a hydrophilic polymerizable initiator, 0 to 10% by mass of a solvent, 0.1 to 10% by mass of a surfactant, and the rest of pure water.

<Active Energy Ray Irradiating Device>

The active energy ray irradiating device is a device capable of performing the second step, specifically, the step of forming the second intermediate image by irradiating the first intermediate image with the active energy rays. As the active energy ray irradiating device, the known irradiating device can be used without particular limitation as long as it can irradiate the first intermediate image with light having a wavelength, such as an absorption wavelength of a polymerization initiator, capable of progressing polymerization, but it is preferable to use an ultraviolet ray irradiating device. The term "ultraviolet rays" as used herein is not limited to a wavelength of strictly 400 nm or less, but mainly refers to light having a short wavelength capable of progressing the polymerization, and in some cases, visible light may be included. Examples of the ultraviolet ray irradiating device include a mercury lamp, a metal halide lamp, an excimer lamp, an LED, and the like.

In the present invention, in order to control the viscoelasticity of the second and third intermediate images, at least one ultraviolet ray irradiating device is arranged at a position 110*c* after the ink applying device 104 and before the liquid absorbing device 105. In this case, the ink may be completely cured, or the ultraviolet ray irradiation may be performed under such a condition that the ink is kept in a semi-cured state in which it is not completely cured. It is possible to expect the effects of making the cured product more flexible, the transferability better, and the like by making the ink into the semi-cured state. Moreover, when the ink is cured in the state in which it contains a large amount of water, the cured product may become a gel form, and the fastness may be inadequate even if water is removed from a gel-like cured product simply. It is a good method to first make ink into a semi-cured state in order to bring the ink into contact with the liquid absorbing member, reduce the amount of water, and then perform main curing.

In the ink jet image forming apparatus according to the present embodiment, at least one ultraviolet ray irradiating device needs to be arranged at a position 110*c* after the ink applying device and before the liquid absorbing device. In the present invention, in addition to this, an arbitrary number of ultraviolet ray irradiating devices can be arranged at arbitrary positions under arbitrary conditions depending on their roles such as temporary fixing of an image, semi-curing, and complete curing, and are not particularly limited. For example, the ultraviolet ray irradiating device can be disposed between the respective heads of the ink applying device mainly for the purpose of suppressing bleeding and beading (110*a*). In addition, for the purpose of the fixing to the recording medium and exhibiting the fastness (hereinafter, the main curing), the ultraviolet ray irradiating device can be arranged for the final image on the recording medium (110*d*).

In addition, each ultraviolet ray irradiation may be performed by a plurality of ultraviolet ray irradiating devices. For example, the irradiation may be performed continuously like the position 110*b* with respect to the position 110*c*, or may be performed at a spaced place like the position 110*a* with respect to the position 110*c*.

In addition to the wavelength, the irradiation conditions of the ultraviolet rays include illuminance or an integrated light quantity. The illuminance is a value indicating a radiant flux per unit area, and $mW/cm^2$ is often used as the unit. The integrated light quantity is a value indicating energy per unit area obtained by integrating illuminance with time, and $mJ/cm^2$ is often used as the unit. Any can be measured with a general illuminometer corresponding to ultraviolet rays.

<Liquid Absorbing Device>

In the present embodiment, the liquid absorbing device 105 is a device that performs the third step, that is, a step of forming a third intermediate image by bringing a liquid absorbing member into contact with the second intermediate image to remove at least a part of the liquid components contained in the second intermediate image. The liquid absorbing device 105 includes a liquid absorbing member 105*a* and a position adjusting member 105*b* for absorbing liquid that brings the liquid absorbing member 105*a* into contact with the second intermediate image on the transfer body 101. The shapes of the liquid absorbing member 105*a* and the position adjusting member 105*b* are not particularly limited. For example, as shown in FIG. 1, the position adjusting member 105*b* has a columnar shape, the liquid absorbing member 105*a* has a belt shape, and the belt-shaped liquid absorbing member 105*a* may be configured to be in contact with the transfer body 101 by the columnar-shaped position adjusting member 105*b*. Further, the position adjusting member 105*b* has a columnar shape, the liquid absorbing member 105*a* has a cylindrical shape formed on a circumferential surface of the columnar-shaped position adjusting member 105*b*, and the cylindrical liquid absorbing member 105*a* may be configured to be in contact with the transfer body 101 by the columnar-shaped position adjusting member 105*b*.

In the present embodiment, considering the space within the ink jet recording apparatus, the liquid absorbing member 105*a* preferably has a belt shape.

Further, the liquid absorbing device 105 having such a belt-shaped liquid absorbing member 105*a* may have a stretching member that stretches the liquid absorbing member 105*a*. In FIG. 1, reference numeral 105*c* denotes a stretching roller as the stretching member. In FIG. 1, the position adjusting member 105*b* is also a roller member that rotates in the same manner as the stretching roller, but is not limited thereto.

In the liquid absorbing device 105, the liquid absorbing member 105*a* having a porous body is brought into contact with the second intermediate image by the position adjusting member 105*b*, so that at least a part of the liquid component contained in the second intermediate image is absorbed into the liquid absorbing member 105*a* to reduce the liquid component. As the method for reducing a liquid component in a second intermediate image, in addition to the present method for bringing the liquid absorbing member into contact with the second intermediate image, other known methods, for example, a heating method, a method for blowing low-humidity air, a decompression method, and the like may be employed in combination with the present method. Further, the liquid component may be further reduced by applying these methods to the second intermediate image after the removal of liquid in which the liquid component is reduced.

(Liquid Absorbing Member)

The liquid absorbing member 105*a* comes into contact with the second intermediate image on the transfer body 101, thereby removing at least a part of the liquid component contained in the second intermediate image. Examples of the material for the liquid absorbing member include an organic material, an inorganic material, a porous material or fiber made of hybrids of an organic material and an inorganic material, and polymer water-absorbing materials. The composition and structure of the surface and the interior are not particularly distinguished and may be the same or different depending on the function.

Either a hydrophilic material or a water repellent material can be used for the liquid absorbing member. Examples of the hydrophilic material include organic materials such as cellulose, polyacrylamide, polyester, polycarbonate, polyamide, polyethersulfone, and sodium polyacrylate, and inorganic materials such as alumina, silica, and glass fiber. In addition, the water repellent material may be hydrophilized by methods such as a sputter etching method, radiation or $H_2O$ ion irradiation, excimer (ultraviolet) laser light irradiation, and plasma irradiation. When the liquid absorbing member is hydrophilic, there is an effect of spontaneously sucking up liquid, particularly water by capillary force, and the liquid can be removed satisfactorily.

Examples of the water repellent material include a fluorine resin such as polytetrafluoroethylene (hereinafter PTFE), polychlorotrifluoroethylene (PCTFE), polyvinylidene fluoride (PVDF), polyvinyl fluoride (PVF), perfluoroalkoxy fluororesin (PFA), a tetrafluoroethylene•hexafluoropropylene copolymer (FEP), an ethylene•tetrafluoroethylene copolymer (ETFE), and an ethylene•chlorotrifluoroethylene copolymer (ECTFE), polyolefin such as polyethylene (PE) and polypropylene (PP), and the like. When the liquid absorbing member is water-repellent, it is possible to suppress adhesion of a color material or the like in the image or to improve cleaning properties. On the other hand, when the liquid absorbing member is water-repellent, the effect of sucking up the liquid by the capillary force is reduced. For this reason, it is preferable that liquid having a contact angle with the liquid absorbing member of less than 90° is previously impregnated into the liquid absorbing member. Further, it is preferable to apply an appropriate contact pressure or suction pressure when the liquid absorbing member comes into contact with the intermediate image.

The liquid absorbing member is a porous material, fiber, or the like, and preferably has pores through which liquid can be penetrated or permeated. When the liquid absorbing member has pores, it is preferable that the pore diameter is substantially equal to or smaller than the size of the solid component and the dissolved component in the intermediate image to be left on the transfer body or the composition (hereinafter the contents to be released) obtained from the components. On the other hand, if the pore diameter is too small, since the flow resistance of the liquid increases, it is also preferable to elaborate an ink by agglomerating the solid component, precipitating or polymerizing the dissolved component, or the like to increase the size or viscosity of the components.

As the shape of the liquid absorbing member, a shape capable of absorbing liquid by once contacting the intermediate image and then circulating and contacting again is preferable, and examples thereof include shapes such as a belt or a drum. In addition, the liquid absorbing member may absorb liquid with a capillary force or affinity with the material as a driving force without substantially pressing when contacting the intermediate image, or an action of pressing and pushing into pores may be added.

Note that the reaction liquid may be applied to a non-image area to which no ink is applied. The liquid absorbing member can remove not only the intermediate image but also the liquid component of the reaction solution. The expression "removing the liquid component from the intermediate image" is not limited in meaning to remove the liquid component from only the intermediate image, but is used as the meaning that at least the liquid component applied to the transfer body needs to be removed.

The liquid component is not particularly limited as long as it does not have a certain shape, has fluidity, and has a substantially constant volume. For example, water, an organic solvent, or the like contained in an ink or a reaction liquid can be used as the liquid component.

In this way, on the transfer body 101, at least a part of the liquid component is absorbed, and an ink image (image) in which the liquid component is reduced is formed. Next, the ink image after the removal of the liquid is transferred to the recording medium 108 by the transfer device. The device configuration and conditions during the transfer will be described.

<Transfer Device>

In the transfer device, a fourth step, that is, a step of forming an image on a recording medium by transferring the third intermediate image from the transfer body to the recording medium is performed. Specifically, the third intermediate image after removing liquid on the transfer body 101 is transferred to the recording medium 108 conveyed by recording medium conveying device 107 by coming into contact with the recording medium 108 by the transfer pressing member 106. By removing at least a part of the liquid component contained in the second intermediate image on the transfer body 101 to form a third intermediate image and then transferring the third intermediate image to the recording medium 108, it is possible to obtain the recording image in which curling, cockling, and the like are suppressed.

The pressing member 106 is required to have a certain degree of structural strength from the viewpoint of the conveyance accuracy and the durability of the recording medium 108. As the material of the pressing member 106, a metal, a ceramic, a resin, or the like is preferably used. In particular, in addition to rigidity and dimensional accuracy that can withstand pressure during the transfer, to reduce control inertia during the operation and improve control responsiveness, aluminum, iron, stainless steel, an acetal resin, an epoxy resin, polyimide, polyethylene, polyethylene terephthalate, nylon, polyurethane, silica ceramics, and alumina ceramics are preferably used. In addition, these materials may be used in combination.

There is no particular limitation on the pressing time during which the pressing member 106 presses the transfer body in order to transfer the third intermediate image after removing the liquid on the transfer body 101 to the recording medium 108. Note that the pressing time in the present embodiment indicates the time during which the recording medium 108 and the transfer body 101 are in contact with each other, and the value is calculated by dividing the length of the pressure area in the conveying direction by the conveying speed.

There is no particular limitation on the temperature at which the pressing member 106 presses the transfer body 101 in order to transfer the third intermediate image after removing the liquid on the transfer body 101 to the recording medium 108.

The shape of the pressing member 106 is not particularly limited, but for example, the pressing member 106 has a roller shape.

The pressure and time for pressing the image on the transfer body 101 against the recording medium 108 may be appropriately adjusted in consideration of transferability or other conditions. In general, the greater the pressure and the longer the time, the better the followability to the irregularities of the recording medium such as paper and the greater the real contact area and the better the transferability. On the other hand, if the pressure is too high, the texture of the paper is impaired, and the possibility of impairing the durability of the transfer body is increased. In addition, since the larger the pressure and the longer the time, the greater the total pressure applied to the transfer pressing member, the device configuration is easily enlarged.

There is no particular limitation on the temperature at which the image on the transfer body 101 is pressed against the recording medium 108, and heating means for heating the intermediate image on the transfer body 101, the transfer body 101, and the recording medium 108 may be provided to obtain these temperatures.

<Recording Medium and Recording Medium Conveying Device>

In the embodiment, the recording medium 108 is not particularly limited, and any known recording medium can be used. Examples of the recording medium include a long product wound in a roll shape, or a single sheet cut into a predetermined size. Examples of the material include paper, plastic film, wood board, cardboard, and metal film, and the like. Further, in FIG. 1, the recording medium conveying device 107 for conveying the recording medium 108 is configured to include a recording medium feeding roller 107*a* and a recording medium take-up roller 107*b*, but the configuration of the recording medium conveying device 107 is not limited as long as the recording medium conveying device 107 can convey the recording medium.

<Control System>

Figure 2:
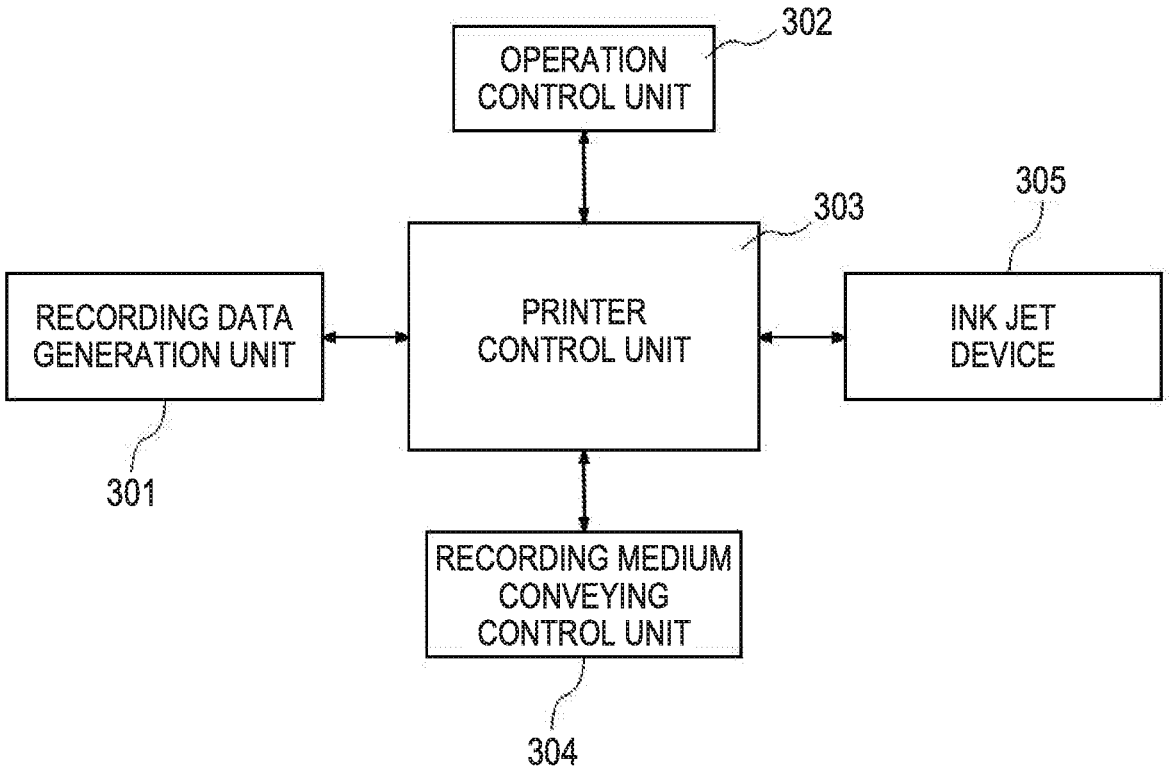
FIG. 2 is a block diagram showing a control system of the entire apparatus in the transfer type ink jet recording apparatus shown in FIG. 1.

The transfer type ink jet recording apparatus in the present embodiment has a control system that controls each apparatus. FIG. 2 is a block diagram showing a control system of the entire apparatus in the transfer type ink jet recording apparatus shown in FIG. 1. In FIG. 2, reference numeral 301 denotes a recording data generation unit such as an external print server, reference numeral 302 denotes an operation control unit such as an operation panel, and reference numeral 303 denotes a printer control unit for performing a recording process. In addition, reference numeral 304 denotes a recording medium conveying control unit for conveying the recording medium, and reference numeral 305 denotes an ink jet device for printing.

Figure 3:
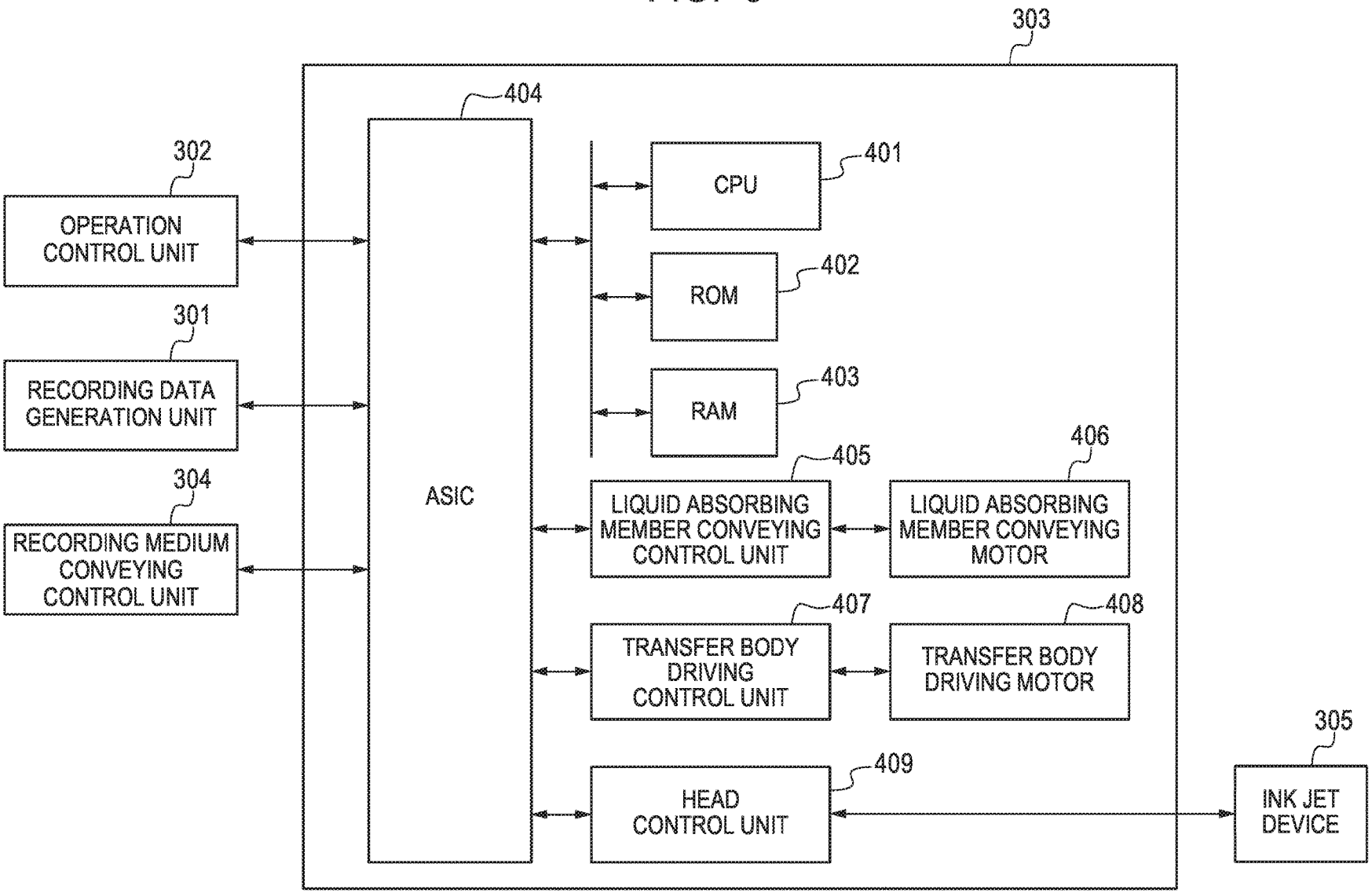
FIG. 3 is a block diagram showing a printer control unit in the transfer type ink jet recording apparatus shown in FIG. 1.

FIG. 3 is a block diagram showing a printer control unit in the transfer type ink jet recording apparatus shown in FIG. 1. Reference numeral 401 denotes a CPU for controlling the entire printer, reference numeral 402 denotes a ROM for storing a control program for the CPU, and reference numeral 403 denotes a RAM for executing the program. Reference numeral 404 denotes an application specific integrated circuit (ASIC) in which a network controller, a serial IF controller, a head data generation controller, a motor controller, and the like is built-in. Reference numeral 405 denotes a liquid absorbing member conveying control unit for driving the liquid absorbing member conveying motor 406, and is command-controlled from the ASIC 404 via the serial IF. Reference numeral 407 denotes a transfer body driving control unit for driving the transfer body driving motor 408, and is similarly command-controlled from the ASIC 404 via the serial IF. Reference numeral 409 denotes a head control unit, and performs final ejection data generation, drive voltage generation, and the like of the ink jet device 305.

In the ink jet image forming apparatus to which the present invention is applied, the liquid absorbing member is brought into contact with the intermediate image on the transfer body after the intermediate image is irradiated with ultraviolet rays, and the intermediate image is transferred to the recording medium. If the intermediate image is soft, the transfer is performed well, but the shift of the intermediate image such as color migration to the liquid absorbing member is likely to occur. On the other hand, if the intermediate image is hard, the shift of the intermediate image to the liquid absorbing member is reduced, but the transfer tends to be insufficient. As a result of the study, the present inventors have found that in order to obtain a satisfactory final image, it is important to control the viscoelasticity before contacting the liquid absorbing member and the viscoelasticity before contacting the recording medium to be within an appropriate range. Specifically, the present inventors have found that when the complex elastic modulus of the second intermediate image is 4.0 or more in the common logarithm, and the complex elastic modulus of the third intermediate image is 7.0 or less in the common logarithm, the intermediate image can be satisfactorily transferred to the recording medium with reducing the shift of the intermediate image to the liquid absorbing member. Here, the shift of the intermediate image to the liquid absorbing member does not necessarily indicate only the shift of the color material, but means that the contents (the component constituting the intermediate image other than the liquid component) to be released, such as a solid content such as a resin cured by the irradiation with ultraviolet rays to be left in the intermediate image, are shifted to the liquid absorbing member.

When the common logarithm of the complex elastic modulus of the second intermediate image and the complex elastic modulus of the third intermediate image are within the above range, the shift of the image to the liquid absorbing member is reduced and transferability is improved. The detailed mechanism of the above phenomenon is unclear, but the present inventors consider the viscoelastic conditions that the intermediate image needs to satisfy as follows.

First, considering the state in which the intermediate image is shifted or transferred to the liquid absorbing member or the recording medium, the adhesion of the intermediate image to the liquid absorbing member or the recording medium increases. It is presumed that this is mainly caused by the fact that the constituent components of the intermediate image penetrate into the fine irregularities of the liquid absorbing member or the recording medium and the contact area increases.

When the penetration length (penetration depth) is represented by 1 and the interval between the irregularities or the radius of the pore diameter is represented by r, the degree of wetting a is defined as the penetration length a with respect to the structure size as shown in the following formula (1).

$$\alpha = \frac{l}{2r} \tag{1}$$

In the above formula (1), the fact that a is larger than 1 means that the penetration length is larger than the interval between the irregularities and the hole diameter, and the contact area with the intermediate image is large and the intermediate image is likely to adhere. When a is smaller than 1, it is indicated that the contact area with the intermediate image is small and the intermediate image is difficult to adhere.

Next, using the concept of dynamic viscoelasticity, the complex elastic modulus G* is defined as the following formula (2).

$$\begin{aligned} G^* &= G' + iG'' \\ &= \frac{\sigma_0}{\varepsilon_0}(\cos\delta + i\sin\delta) \end{aligned} \tag{2}$$

In the above formula (2), G' is the storage elastic modulus, G" is the loss elastic modulus, co is the strain amplitude, $\sigma_0$ is the stress amplitude, and δ is the phase difference between strain and stress.

In the following, since the phase difference is not particularly considered, the absolute value of G* is defined as the complex elastic modulus as it is shown in the following formula (3) unless otherwise specified.

$$|G^*| = \frac{\sigma_0}{\varepsilon_0} \tag{3}$$

The complex elastic modulus can be converted into the complex viscosity η* using an angular frequency ω as shown in the following formula (4).

$$|G^*| = \omega|\eta^* \tag{4}$$

Here, considering the relationship between the viscoelasticity of the intermediate image and the penetration length into the liquid absorbing member or the recording medium, the Olsson-Pihl formula can be extended to the complex viscosity and described as the following formula (5).

$$l = \sqrt{\frac{2r\gamma\cos\theta + pr^2}{4|\eta^*|}t} \tag{5}$$

In the above formula (5), γ is the surface tension of the intermediate image, θ is the contact angle of the intermediate image with the liquid absorbing member or the recording medium, and p is the pressure (hereinafter referred to as contact pressure) acting between the intermediate image and the liquid absorbing member or the recording medium. t is the time for the intermediate image to pass through the contact portion with the liquid absorbing member or the recording medium (hereinafter referred to as nip time).

The dynamic viscoelasticity usually considers a response to a sinusoidal input. The deformation that the intermediate image undergoes from the liquid absorbing member or the recording medium is not necessarily sinusoidal, but as a first approximation, the frequency, which is referred to as f, can be defined as the following formula (6).

$$f = \frac{1}{t} \tag{6}$$

Therefore, using the following formula (7) and the above formula (4), the above formula (5) can be rewritten as the following formula (8).

$$\omega = 2\pi f \tag{7}$$

$$l = \sqrt{\frac{2r\gamma\cos\theta + pr^2}{4|G^*|}\pi} \tag{8}$$

By substituting formula (1) into formula (8) and rearranging the magnitude relationship between α and 1, the following formula (9) is obtained for the complex elastic modulus.

$$|G^*| \leqslant \frac{\pi}{8}\left(\frac{2\gamma\cos\theta}{r} + p\right) \tag{9}$$

When the inequality sign in formula (9) is reversed, it can be considered that the shift of the intermediate image to the liquid absorbing member or the transferability to the recording medium change.

Therefore, by applying the conditions that can be taken in the actual image forming process, the appropriate range of the complex elastic modulus of the second intermediate image before the intermediate image comes into contact with the liquid absorbing member and the complex elastic modulus of the third intermediate image before the third intermediate image comes into contact with the recording medium is obtained.

First, for the complex elastic modulus before the second intermediate image comes into contact with the liquid absorbing member, when γ=20 mN/m, θ=60°, r=1 μm, and p=10 gf/cm$^2$, 8.2×10$^3$ Pa (=10$^{3.9}$ Pa) is obtained from the above formula (9). Here, even if γ and cos θ are changed, they are in a negative correlation as known from Zisman-plot, and the product thereof does not change greatly. The maximum value of r is determined by a dot size and a film thickness of an image, which cannot be changed greatly. The minimum value of p is determined by the mechanical accuracy that can guarantee the reliable contact, which cannot be changed greatly. Therefore, it can be considered that to reduce the shift of the second intermediate image to the liquid absorbing member, the complex elastic modulus (Pa) of the second intermediate image needs to be 4.0 or more in the common logarithm before the second intermediate image comes into contact with the liquid absorbing member. In addition, it is preferable that the complex elastic modulus (Pa) of the second intermediate image is 5.0 or more. Although a hydrophilic liquid absorbing member is assumed here, in the case of a hydrophobic liquid absorbing member, the second term is dominant instead of the first term in the above formula (9), and the range of proper complex elastic modulus remains the same.

The upper limit of the complex elastic modulus of the second intermediate image before the second intermediate image comes into contact with the liquid absorbing member is not particularly limited, but the complex elastic modulus (Pa) of the second intermediate image is preferably 10.0 or less in the common logarithm before the second intermediate image comes into contact with the liquid absorbing member so that the liquid component held inside the intermediate image can easily come out on the surface of the intermediate image to perform the removal of the liquid component more efficiently.

Next, for the complex elastic modulus of the third intermediate image before the third intermediate image comes into contact with the liquid absorbing member, when y=20 mN/m, θ=60°, r=1 μm, and p=100 kgf/cm$^2$, 3.9×10$^6$ Pa (=10$^{6.6}$ Pa) is obtained from the above formula (9). Here, the fact that the product of γ and cos θ does not change greatly is as described above. r indicates the roughness of the recording medium (interval between irregularities), but is generally about 1 μm for coated paper with a small roughness. The maximum value of p is determined by conditions that the texture of the paper is not lost and mechanical constraints, which is not changed greatly. Therefore, it can be considered that to make the transferability of the third intermediate image to the recording medium good, the complex elastic modulus (Pa) of the third intermediate image needs to be 7.0 or less in the common logarithm before the third intermediate image comes into contact with the recording medium. In addition, it is preferable that the complex elastic modulus (Pa) of the third intermediate image is 6.0 or less.

The lower limit of the complex elastic modulus of the third intermediate image before the third intermediate image comes into contact with the recording medium is not particularly limited, but in order to make it difficult to cause cohesive fracture inside the intermediate image during the transfer, so-called tearful parting, the complex elastic modulus (Pa) of the third intermediate image is preferably 3.0 or more in the common logarithm before the third intermediate image comes into contact with the recording medium.

In summary, the following conclusions are obtained.

By setting the complex elastic modulus (Pa) of the intermediate image to be 4.0 or more in the common logarithm before the intermediate image comes into contact with the liquid absorbing member and 7.0 or less before the intermediate image comes into contact with the recording medium, it is possible to reduce the shift of the intermediate image to the liquid absorbing member and satisfactorily perform the transfer of the intermediate image to the recording medium. More preferably, the complex elastic modulus (Pa) of the intermediate image is 5.0 or more in the common logarithm before the intermediate image comes into contact with the liquid absorbing member and 6.0 or less before the intermediate image comes into contact with the recording medium. In addition, the complex elastic modulus (Pa) of the intermediate image is 10.0 or less in the common logarithm before the intermediate image comes into contact with the liquid absorbing member and 3.0 or more before the intermediate image comes into contact with the recording medium.

Although this range is assumed to vary depending on various conditions, if an actually good ink jet image forming apparatus is designed as described above, the complex elastic modulus (Pa) does not deviate from this range.

Note that the common logarithm of the complex elastic modulus (Pa) of the intermediate image is not necessarily 7.0 or less, which is the upper limit before the intermediate image comes into contact with the recording medium, before the intermediate image comes into contact with the liquid absorbing member. This is because the complex elastic modulus of the intermediate image may be reduced after the intermediate image comes into contact with the liquid absorbing member by removing the liquid, which will be described later, by heating before the intermediate image comes into contact with the recording medium, or the like.

For the measurement of the complex elastic modulus, a general rheometer capable of measuring dynamic viscoelasticity can be used. The intermediate image may be directly measured, or an ink film simulating a state during the image formation may be measured. In the measurement of the dynamic viscoelasticity, the frequency of strain to be input can be designated, but this frequency is preferably the reciprocal of the nip time as shown in the above formula (6).

The method for controlling a complex elastic modulus within the above range is not particularly limited, but the control by the blending amount or blending ratio of the polymerizable component in the ink, or the integrated light quantity or illuminance of the irradiation with ultraviolet rays can be suitably used. In addition, it is also possible to control the complex elastic modulus by change in temperature due to heating or cooling or change in the amount of water such as drying. The agglomeration by the reaction liquid also has a certain effect on the complex elastic modulus. Hereinafter, the conditions, the operations, and the like that have a certain influence on the complex elastic modulus will be described.

In the first intermediate image, the state of the component that is cured by the irradiation with active energy rays has a certain effect on the complex elastic modulus. That is, in the second step of irradiating the first intermediate image with the active energy rays, when the component that is cured by the irradiation with active energy rays is easy to move and the concentration thereof is high, the formed reaction product tends to form a strong cured product having a high molecular weight and a large intermolecular interaction. Therefore, the amount of water contained in the intermediate image before the second step is preferably 90% by mass or less, more preferably 80% by mass or less, and still more preferably 70% by mass or less based on the total mass of the intermediate image.

In the amount of water in the intermediate image before the second step, the residual amount of water can be obtained by measuring the mass of the first intermediate image immediately after the ink application and the mass of the intermediate image before the second step (i.e., before irradiation with ultraviolet rays), and using the difference therebetween.

It is more preferable that the ink contains at least both a monofunctional polymerizable component and a polyfunctional polymerizable component as the polymerizable component. The ink often becomes too soft if the ink contains only the monofunctional polymerizable component. On the other hand, when the ink contains only the polyfunctional polymerizable component, flexibility and breaking elongation are often inferior. By containing the monofunctional polymerizable component in addition to the polyfunctional polymerizable component, the flexibility and the breaking elongation are improved. Therefore, the complex elastic modulus of the intermediate image is in the above range, and it can be expected to further reduce the fracture and the like of the intermediate image, reduce the color migration to the liquid absorbing member, and improve the transferability. The blending ratio of the monofunctional polymerizable component to the polyfunctional polymerizable component is not particularly limited, but it is more preferable that the polyfunctional polymerizable component is contained at a ratio of 1/60 or more of the monofunctional polymerizable component.

It is preferable that the component cured by the irradiation with active energy rays contains a component which imparts flexibility and a component which imparts a network structure. The component imparting the flexibility contains at least one of monofunctional component or difunctional component, and it is more preferably that at least one monofunctional component is contained. The component imparting the network structure contains at least one polyfunctional component having difunctional or higher, and it is more preferable that a polyfunctional component of a trifunctional or higher is contained.

The difunctional component that is a component that imparts flexibility and the difunctional component that forms a network structure may be the same component or different components. In addition, the component cured by the irradiation with active energy rays may be composed of only the difunctional component.

It is preferable that at least one component cured by the irradiation with the active energy rays is water-soluble. Furthermore, it is more preferable that at least one of the water-soluble components is the component that imparts the flexibility. In particular, from the viewpoint of the ink stability, the adhesion to the substrate, and the hydrophilicity imparting to the cured film, it is more preferable that at least one of the water-soluble components has an acrylamide structure or a methacrylamide structure.

In the present invention, it is preferable that the composition of the component cured by the active energy rays satisfies the relationship represented by the following General Formula (I).

$$-0.30<\log_{10}((\text{total number of functional groups of monofunctional component}+\text{total number of functional groups of difunctional component})/\text{total number of functional groups of polyfunctional component})<1.80 \quad \text{General Formula (I)}$$

The range of General Formula (I) is more preferably 0 or more and 1.20 or less, and more preferably 0.20 or more and 0.90 or less.

The water content in the ink is preferably 85% by mass or less, more preferably 80% by mass or less, and still more preferably 75% by mass or less based on the total mass of the ink in order to effectively impart ink stability such as ejection ability or storage stability and curability by the active energy rays. The water content in the ink is particularly preferably 70% by mass or less.

General Formula (I) represents the number of network structures imparting a crosslinked structure, that is, the crosslinking density, with respect to the number of chains imparting flexibility. The value of General Formula (I) can be obtained by multiplying the number of moles of each component contained in the ink according to the present invention by the number of functional groups to obtain the number of moles of functional groups of each component and applying the obtained number of moles of functional groups to the above formula as the total number of functional groups. When the component cured by the active energy rays contains a difunctional component, the difunctional component is a component that imparts flexibility and also corresponds to a component that forms a network structure. For this reason, the difunctional component is counted as both the difunctional component in the numerator and the polyfunctional component in the denominator of the fraction represented by the logarithm in General Formula (I). When the component cured by the active energy rays is only the difunctional component, the values of the numerator and the denominator are the same value, so the value of General Formula (I) is 0.

At least one of the components that are cured by the active energy rays is preferably water-soluble because the stability of the water-based ink is improved. It is more preferable that at least one of the water-soluble components cured by the active energy rays is the component that imparts the flexibility. It is further more preferable that at least one of the water-soluble components cured by the active energy rays has an acrylamide structure or a methacrylamide structure.

When the active energy rays are ultraviolet rays, the complex elastic modulus of the intermediate image generally increases with the increase in the integrated light quantity, and eventually converges to a constant value. By controlling the integrated light quantity, the complex elastic modulus can be controlled within the range up to this converged value. The integrated light quantity is not particularly limited, but is preferably 1 $mJ/cm^2$ to 10 $J/cm^2$. Further, the integrated light quantity is more preferably 10 $mJ/cm^2$ to 1 $J/cm^2$. However, since the complex elastic modulus increases exponentially with respect to the integrated light quantity until it approaches convergence, the complex elasticity is prone to be uneven due to the difference in the ejection amount of ink, such as when ink having high concealment property for ultraviolet rays is used. Therefore, in the controlling of the complex elastic modulus, it is more preferable to use not only the integrated light quantity but also the ink composition. In addition, it is preferable to control the complex elastic modulus within the above range by using the integrated light quantity in which the change in the complex elastic modulus with respect to the integrated light quantity is reduced.

From the above points, it is preferable that the integrated light quantity is 1/100 or more of the integrated light quantity at which the complex elastic modulus is 63% of the converged complex elastic modulus (amount which is $1-e^{-1}$ and is used for an index of exponential relaxation phenomenon).

In addition, the complex elastic modulus of the intermediate image can be controlled even by the illuminance or illuminance distribution of ultraviolet rays. When the illuminance increases, the same integrated light quantity can be obtained in a short time, which is advantageous in speeding up the process and reducing the size. However, it was found that even when the integrated light quantity is the same, the complex elastic modulus may decrease when the illuminance is high. It is confirmed that the molecular weight of the intermediate image decreases when the illuminance is high, and it is considered that the concentration of radicals generated at the same time increases, and thus the molecular weight decreases due to termination reaction due to recombination and the like, and the complex elastic modulus decreases. This effect is alleviated when the molecular weight is large and the complex elastic modulus is large originally, and becomes more pronounced when the molecular weight is small and the complex elastic modulus is small originally. Therefore, the irradiation with high illuminance does not so effectively work for controlling the complex elastic modulus within the range of improving transferability, but rather often works disadvantageously so that the complex elastic modulus is out of the range where the shift of the image to the liquid absorbing member is reduced.

However, as a result of the study by the present inventors, it has been found that even when the irradiation with high illuminance is performed, the reduction in the complex elastic modulus due to the irradiation with high illuminance can be suppressed by performing irradiation with low illuminance followed by performing the irradiation with high illuminance. This is expected that the reduction in the molecular weight due to the high illuminance is suppressed by forming a structure that becomes a nucleus having a high molecular weight to some extent at an early stage of the polymerization reaction.

From the above, it is more preferable that the irradiation with ultraviolet rays has a lower illuminance upstream than downstream. Further, it is more preferable that the irradiation with ultraviolet rays is performed by the plurality of irradiating devices, and the illuminance of the irradiating device on the upstream is smaller than the illuminance of the irradiating device on the downstream. The plurality of irradiating devices may be arranged continuously before the third step, or at least one thereof is arranged between the heads of the ink applying device apart from the third step for the purpose of temporarily fixing the image.

The integrated light quantity of the irradiation with low illuminance may be significantly smaller than the integrated light quantity of the irradiation with high illuminance. More preferably, the integrated light quantity of the irradiation with low illuminance is 1/100 or more of the integrated light quantity of the irradiation with high illuminance. On the other hand, the illuminance of the irradiation with low illuminance may have a difference from the illuminance of the irradiation with high illuminance to some extent. More preferably, the illuminance of the irradiation with low illuminance is ½ or less of the illuminance of the irradiation with high illuminance.

The complex elastic modulus of the intermediate image may change as the liquid is removed. Usually, when a solvent is removed from liquid or a solution containing a solid content, the concentration of the solid content or the solute increases to increase the viscosity. However, at least in water-based UV curable inks, it has been found that the complex elastic modulus may be reduced by removing the liquid after the irradiation with ultraviolet rays. At this time, the change in temperature due to heating or the like is not particularly given. Further, since the same phenomenon occurs not only by removing the liquid by the liquid absorbing member but also by simple drying, the expression and the like of thixotropy due to the contact with the liquid absorbing member is not a main factor. It is known that since the complex elastic modulus starts to increase by complete drying, the reduction in the complex elastic modulus due to the removal of liquid occurs due to the removal of the intermediate amount of liquid. The mechanism of this phenomenon is not sufficiently clear, but can be estimated as follows.

The water-based UV curable ink becomes a gel containing water well by the irradiation with ultraviolet rays. The gel has a three-dimensional network structure, and water is held in the structure so that water is taken into the structure. Depending on the structure of the molecular chains constituting the gel and the affinity with water, the water is difficult to flow. Furthermore, the molecular chain itself is extended and is supported by water and thus hardly deformed, and exhibits a high complex elastic modulus. When water is removed from this state, the deformation of the molecular chain is allowed and the complex elastic modulus is reduced. When completely dried, the molecular chains are close to each other to form an intermolecular bond, and are hard to deform again, and the complex elastic modulus starts to increase.

In any case, the reduction of the complex elastic modulus of the intermediate image due to the removal of the liquid contributes to increase the complex elastic modulus of the second intermediate image before the second intermediate image comes into contact with the liquid absorbing member, and reduce the complex elastic modulus of the third intermediate image before the third intermediate image comes into contact with the recording medium. For this reason, it is preferable to reduce the complex elastic modulus of the intermediate image by removing the liquid because the reduction in the shift of the image to the liquid absorbing member and the improvement in the transferability can be further expected. The liquid removal rate is more preferably 95% or less.

EXAMPLES

The present invention will be described in detail below with reference to examples and comparative examples. The present invention is not limited to the following examples as long as the present invention does not depart from the gist. Unless otherwise specified, "part" represents parts by mass and "%" represents % by mass.

(Preparation of Pigment Dispersion)

After mixing the following raw materials, the obtained mixture was put into a batch type vertical sand mill (manufactured by AIMEX CO., LTD.), charged with 200 parts of zirconia bead having a diameter of 0.3 mm, water-cooled, and subjected to the dispersion treatment for 5 hours.

Pigment red 122: 10%

Resin aqueous solution (pigment dispersant): 15%

Resin: Styrene-acrylic acid-ethyl acrylate copolymer (Acid value 150, weight average molecular weight 8000, aqueous solution of solid content of 20%, neutralizing agent KOH)

Ion exchange water: 75%

Next, coarse particles of this dispersion were removed by a centrifugal separator, and pigment dispersion 1 having a pigment concentration of 10% was obtained.

(Preparation of Ink)

Inks 1 to 29 were prepared with the compositions shown below.

Pigment dispersion 1: 20.00%

Polymerizable components

Polymerizable component 1 (No. 1 in Table 1)

Polymerizable component 2 (No. 2 in Table 1)

Polymerizable component 5 (No. 5 in Table 1)

Polymerizable component 7 (No. 7 in Table 1)
Polymerizable component 10 (No. 10 in Table 1)
Polymerizable component 13 (No. 13 in Table 1)
Other polymerizable components
Polymerization initiator 1 (PI-1 in Table 2)
Surfactant (Acetyleneol EH manufactured by Kawaken Fine Chemicals Co., Ltd.): 1.00%
Ion exchange water: Balance In the composition, the ratio of the polymerizable component and the polymerization initiator is shown in Table 3 together with the middle side of General Formula (I).

Ink 27 and Ink 29 were prepared using "WBR-829D" (solid content 38.6%) manufactured by Taisei Fine Chemical CO., Ltd., which is a UV cured emulsion, as other polymerizable components so that the solid contents thereof become the ratio shown in Table 3.

Ink 28 was prepared using "USECOAT7655" (solid content 35%) manufactured by Daicel Cytec Co., Ltd, which is a UV cured emulsion, as other polymerizable components so that the solid content thereof becomes the ratio shown in Table 3.

These UV cured emulsions do not contain a component that imparts flexibility as defined in the present invention.

Inks 1 to 6, 11, 13 to 20, and 22 to 24 contain both monofunctional and polyfunctional monomers as the polymerizable component.

Inks 1 to 6 and 11 to 20 satisfy General Formula (I).

Examples 1 to 20

In these examples, image formation was performed using the following transfer type ink jet recording apparatus. A transfer body having the following configuration was used, and was fixed to a support member with an adhesive and then conveyed at a conveying speed of 600 mm/s. The transfer type ink jet recording apparatus does not particularly have a heating and cooling mechanism.

(Transfer Body)

A PET sheet having a thickness of 0.5 mm was coated with silicone rubber (trade name "KE12" manufactured by Shin-Etsu Chemical Co., Ltd.) to a thickness of 0.3 mm to form an elastic layer. Glycidoxypropyltriethoxysilane and methyltriethoxysilane were mixed at a molar ratio of 1:1 to produce a mixture of a condensate obtained by heating under reflux and a photocationic polymerization initiator (trade name "OPTOMER SP150" manufactured by ADEKA CORPORATION). Atmospheric pressure plasma treatment was performed so that the contact angle of water on the elastic layer surface was 10° or less. Thereafter, the transfer body 101 was produced by applying a mixture to the elastic layer, forming a film by UV irradiation (high pressure mercury lamp, integrated exposure 5000 mJ/cm$^2$) and heat curing (150° C., 2 hours), and forming a surface layer having a thickness of 0.5 μm on the elastic body.

TABLE 3

| | Polymerizable component (%) | | | | | | | Polymerization | $\log_{10}$(total number of functional groups of monofunctional component + total number of functional groups of difunctional component/total number of |
|---|---|---|---|---|---|---|---|---|---|
| Ink | 1 Monofunctional | 2 | 5 Difunctional | 7 Trifunctional | 10 Tetrafunctional | 13 Difunctional | Others Emulsion | initiator 1 (%) | functional groups of polyfunctional component) |
| 1 | 29.50 | | | 0.50 | | | | 4.50 | 1.66 |
| 2 | 29.00 | | | 1.00 | | | | | 1.35 |
| 3 | 27.00 | | | 3.00 | | | | | 0.84 |
| 4 | 24.00 | | | 6.00 | | | | | 0.49 |
| 5 | 18.00 | | | 12.00 | | | | | 0.06 |
| 6 | 12.00 | | | 18.00 | | | | | −0.29 |
| 7 | | | | 7.00 | | | | 1.05 | — (Out of target) |
| 8 | | | | 10.00 | | | | 1.50 | |
| 9 | | | | 15.00 | | | | 2.25 | |
| 10 | | | | 20.00 | | | | 3.00 | |
| 11 | | 24.00 | 6.00 | | | | | 0.75 | |
| 12 | | | 30.00 | | | | | | 0.00 |
| 13 | 24.00 | | | | | 6.00 | | 4.50 | 0.90 |
| 14 | 21.00 | | | | | 9.00 | | | 0.70 |
| 15 | 24.00 | | | | 6.00 | | | | 0.65 |
| 16 | 12.00 | | | | 18.00 | | | | −0.13 |
| 17 | | 19.00 | 6.00 | | | | | 3.75 | 0.67 |
| 18 | 16.00 | | | | 4.00 | | | 3.00 | 0.65 |
| 19 | 5.00 | | 15.00 | | | | | | 0.17 |
| 20 | 8.00 | | | 9.00 | | | | 2.55 | −0.17 |
| 21 | 30.00 | | | | | | | | — (Out of target) |
| 22 | 29.80 | | | 0.20 | | | | | 2.06 |
| 23 | 29.65 | | | 0.35 | | | | 4.50 | 1.81 |
| 24 | 3.00 | | | 27.00 | | | | | −1.07 |
| 25 | | | | 30.00 | | | | | |
| 26 | | | | 4.00 | | | | 0.60 | — (Out of target) |
| 27 | | | | | | | WBR829D 15.00 | 2.25 | |
| 28 | | | | | | | UCECOAT 7655 10.00 | 1.50 | |
| 29 | | | | | | | WBR829D 10.00 | | |

First, the reaction liquid having the following composition was applied to the transfer body using the reaction liquid applying device. A gravure offset roller was used in the reaction liquid applying device, and the following reaction liquid was applied at 0.6 g/m$^2$.

(Reaction Liquid)

Glutaric acid: 50.0%

KOH: 2.0%

Surfactant (SN WET 125 manufactured by SAN NOPCO LIMITED): 1.5%

2-pyrrolidone: 5.0%

Ion exchange water: 41.5%

Next, inks 1 to 20 having the above composition were each applied to the transfer body by the ink applying device to form a first intermediate image. Examples 1 to 20 are obtained by changing the type of ink to be applied, and the corresponding relationship thereof is shown in Table 4. For the ink applying device, an ink jet head (nozzle array density 1200 dpi) of a type that ejects an ink by an on demand method using an electro-thermal conversion element was used, and was driven at a frequency of 14.173 kHz to apply ink at 10 g/m$^2$. The ink jet head did not scan so-called serially, and the nozzle row was fixed so as to be substantially orthogonal to the conveyance direction of the recording medium.

The application amount of the reaction liquid and the ink was calculated by measuring the weight of the transfer body before and after application.

Next, the first intermediate image on the transfer body was irradiated with ultraviolet rays using two UV-LED irradiating devices (UV-LED L6011, wavelength 395 nm, manufactured by USHIO INC.) to form a second intermediate image. Each peak illuminance was 200 mW/cm$^2$, and each integrated light quantity was 50 mJ/cm$^2$, and the total was 100 mJ/cm$^2$.

Next, a liquid absorbing member (POREFLON (registered trademark) hydrophilic film HPW-045-30, manufactured by Sumitomo Electric Fine Polymer, Inc.) was brought into contact with the second intermediate image on the transfer body to remove the ink solvent and form a third intermediate image. The liquid absorbing member is a porous hydrophilic PTFE film having a pore diameter of 450 nm and a thickness of 30 μm. The pressing member was a φ100 mm roller having a surface of 10 mm that was made of sponge and pressed a liquid absorbing member against the ink image at a pressure of 9.8 hPa (10 gf/cm$^2$) by supporting the liquid absorbing member on the surface. The nip width was 20 mm and the contact time was 33 ms.

Next, the recording medium was brought into pressure contact with the third intermediate image on the transfer body, and transferred the third intermediate image from the transfer body to the recording medium to form an image on the recording medium. As the recording medium, coated paper (aurora coated paper, basis weight 127.9 g/m$^2$, manufactured by Nippon Paper Industries Co., Ltd.) was used and conveyed at a conveyance speed of 600 mm/s. The pressing member for transfer was a φ150 mm roller having a surface of 3 mm that was made of rubber and pressed against the third intermediate image at a pressure of 9.8 MPa (100 kgf/cm$^2$). The nip width was 20 mm and the contact time was 33 ms.

(Measurement of Complex Elastic Modulus (Pa))

The complex elastic modulus of the intermediate image was measured as follows.

First, a glass substrate was used instead of the transfer body, and except for this, an intermediate image was formed on the glass substrate by the above-described method. In the process of forming the intermediate image, the complex elastic modulus was measured immediately after taking out the glass substrate on which the second intermediate image was formed after the irradiation with ultraviolet rays and before contacting the liquid absorbing member. Further, the complex elastic modulus was measured immediately after taking out the glass substrate on which the third intermediate image was formed after contacting the liquid absorbing member and before contacting the recording medium.

For measurement of the complex elastic modulus, "Rheometer MCR302" (trade name) manufactured by Anton Paar was used. In a vibration mode, the frequency was 30 Hz which is the reciprocal of the nip time, the displacement was 1%, and the normal force was 1 N. Table 4 shows the measurement results of the complex elastic modulus (Pa).

From Table 4, all the complex elastic moduli of the second intermediate images (before contacting the liquid absorbing member) of Examples 1 to 20 were 4.0 or more in the common logarithm. Further, all the complex elastic moduli of the third intermediate image (before contacting the recording medium) were 7.0 or less. In addition, the complex elastic modulus of the second intermediate image (before contacting the liquid absorbing member) of Example 6 was 7.0 or more in the common logarithm, but the complex elastic modulus of the third intermediate (before contacting the recording medium) was 7.0 or less.

Examples 21 to 24

The ink to be applied was changed as shown in Table 4, and the reaction liquid was not applied. Except for this, the image formation and the measurement of complex elastic modulus were performed in the same manner as in Examples 1 to 20.

All the complex elastic moduli of the second intermediate images (before contacting the liquid absorbing member) were 4.0 or more in the common logarithm. Further, all the complex elastic moduli of the third intermediate image (before contacting the recording medium) were 7.0 or less.

TABLE 4

| | | | $\log_{10}(G^*(Pa))$ | |
|---|---|---|---|---|
| | Ink | Reaction liquid | Before contacting liquid absorbing member | Before contacting recording medium |
| Example 1 | 1 | Presence | 4.1 | 3.8 |
| Example 2 | 2 | | 4.6 | 4.1 |
| Example 3 | 3 | | 5.4 | 5 |
| Example 4 | 4 | | 6 | 5.8 |
| Example 5 | 5 | | 6.8 | 6.3 |
| Example 6 | 6 | | 7.2 | 6.5 |
| Example 7 | 7 | | 4.7 | 5 |
| Example 8 | 8 | | 5.6 | 5.4 |
| Example 9 | 9 | | 6.4 | 5.8 |
| Example 10 | 10 | | 6.9 | 6.5 |
| Example 11 | 11 | | 5.6 | 5.4 |
| Example 12 | 12 | | 6.1 | 5.8 |
| Example 13 | 13 | | 5.3 | 5.5 |
| Example 14 | 14 | | 5.2 | 5.4 |
| Example 15 | 15 | | 5.8 | 5.6 |
| Example 16 | 16 | | 6.7 | 6.3 |
| Example 17 | 17 | | 5.1 | 4.9 |
| Example 18 | 18 | | 5 | 4.8 |
| Example 19 | 19 | | 5.7 | 6 |
| Example 20 | 20 | | 4.2 | 4.5 |
| Example 21 | 1 | Absence | 4.2 | 4 |
| Example 22 | 3 | | 5.6 | 5.3 |

TABLE 4-continued

| | Ink | Reaction liquid | $\log_{10}(G^*(Pa))$ Before contacting liquid absorbing member | Before contacting recording medium |
|---|---|---|---|---|
| Example 23 | 4 | | 6.2 | 5.9 |
| Example 24 | 5 | | 6.9 | 6.4 |

Comparative Examples 1 to 7

The ink to be applied was changed as shown in Table 5. Except for this, the image formation and the measurement of complex elastic modulus were performed in the same manner as in Examples 1 to 20.

The complex elastic moduli (Pa) of the second intermediate images (before contacting the liquid absorbing member) of Comparative Examples 1 to 3 and 6 were less than 4.0 in the common logarithm. In Comparative Example 1, the polymerizable component is consisted only of the monofunctional polymerizable component 1, and the complex elastic modulus was particularly small. Further, in Comparative Examples 1 to 3, and 6, when the second intermediate image came into contact with the liquid absorbing member, the color was substantially migrated from the second intermediate image to the liquid absorbing member, and the complex elastic modulus of the third intermediate image (before contacting the recording medium) was not be measured. The complex elastic moduli (Pa) of the second intermediate images (before contacting the liquid absorbing member) of Comparative Examples 4, 5, and 7 were 4.0 or more in the common logarithm, but the complex elastic moduli of the third intermediate image (before contacting the recording medium) was 7.0 or more.

Comparative Example 8

The ink to be applied was changed as shown in Table 5, and the reaction liquid was not applied. Except for this, the image formation and the measurement of complex elastic modulus were performed in the same manner as in Examples 1 to 20.

The complex elastic modulus (Pa) of the second intermediate image (before contacting the liquid absorbing member) was less than 4.0 in the common logarithm. This is considered that even if the second intermediate image is irradiated with ultraviolet rays before agglomeration of the UV cured emulsion or film formation, the complex elastic modulus of the whole film does not increase because particles are not connected to each other. Further, when the second intermediate image came into contact with the liquid absorbing member, the color was substantially migrated from the second intermediate image to the liquid absorbing member, and the complex elastic modulus of the third intermediate image (before contacting the recording medium) was not be measured.

TABLE 5

| | Ink | Reaction liquid | $\log_{10}(G^*(Pa))$ Before contacting liquid absorbing member | Before contacting recording medium |
|---|---|---|---|---|
| Comparative Example 1 | 21 | Presence | 3.0 or less | — (No measurement) |
| Comparative Example 2 | 22 | | 3.5 | |
| Comparative Example 3 | 23 | | 3.9 | |
| Comparative Example 4 | 24 | | 7.0 | 7.0 |
| Comparative Example 5 | 25 | | 7.4 | 7.4 |
| Comparative Example 6 | 26 | | 3.5 | — (No measurement) |
| Comparative Example 7 | 27 | | 7.2 | 7.6 |
| Comparative Example 8 | 28 | Absence | 3.0 or less | — (No measurement) |

Examples 25 and 26

The image formation and the measurement of the complex elastic modulus were performed in the same manner as in Example 3 except that the irradiation conditions with ultraviolet rays were changed between the irradiating device on the upstream and the irradiating device on the downstream as shown in Table 6. In order to make the comparison easier to understand, Table 6 shows the irradiation conditions with ultraviolet rays and the measurement results of Example 3 again.

TABLE 6

| | Ink | Reaction liquid | Irradiation condition of ultraviolet ray: Upstream irradiating device Peak illuminance ($mW/cm^2$) | Upstream irradiating device Integrated light quantity ($mJ/cm^2$) | Downstream irradiating device Peak illuminance ($mW/cm^2$) | Downstream irradiating device Integrated light quantity ($mJ/cm^2$) | Total integrated light quantity ($mJ/cm^2$) | $\log_{10}(G^*(Pa))$ Before contacting liquid absorbing member | Before contacting recording medium |
|---|---|---|---|---|---|---|---|---|---|
| Example 25 | 3 | Presence | — | | 1000 | 100 | 100 | 4.9 | 4.3 |
| Example 26 | | | 200 | 20 | 1000 | 80 | | 5.3 | 4.4 |
| (Example 3) | | | 200 | 50 | 200 | 50 | | 5.4 | 5.0 |

In Examples 25 and 26, the complex elastic modulus of the second intermediate image (before contacting with the liquid absorbing member) was 4.0 or more in the common logarithm. In addition, the complex elastic modulus of the third intermediate image (before contacting with the recording medium) was 7.0 or less. However, in Example 25, the complex elastic modulus of the second intermediate image (before contacting the liquid absorbing member) was smaller than the complex elastic modulus of the second intermediate image of Example 3. On the other hand, in Example 26, the complex elastic modulus of the second intermediate image (before contacting the liquid absorbing member) was substantially the same as the complex elastic modulus of the intermediate image of Example 3. In Example 26, when the irradiation with ultraviolet rays was not performed downstream, and the irradiation was performed only upstream, the complex elastic modulus (Pa) of the second intermediate image (before contacting the liquid absorbing member) was 4.2 in the common logarithm. From the above, it was found that the complex elastic modulus of the second intermediate image in Example 26 reaches the same value as the complex elastic modulus of the second intermediate image of Example 3 not by only the upstream irradiation but by the combination of the upstream and downstream irradiations.

Comparative Example 9

The image formation and the measurement of the complex elastic modulus were performed in the same manner as in Comparative Example 5 except that the irradiation conditions with ultraviolet rays were changed as shown in Table 7. In order to make the comparison easier to understand, Table 7 shows the irradiation conditions with ultraviolet rays and the measurement results of Comparative Example 5.

TABLE 7

| | | | Irradiation condition of ultraviolet ray | | | | | | |
|---|---|---|---|---|---|---|---|---|---|
| | | | Upstream irradiating device | | Downstream irradiating device | | Total | $\log_{10}(G^*(Pa))$ | |
| | Ink | Reaction liquid | Peak illuminance (mW/cm$^2$) | Integrated light quantity (mJ/cm$^2$) | Peak illuminance (mW/cm$^2$) | Integrated light quantity (mJ/cm$^2$) | integrated light quantity (mJ/cm$^2$) | Before contacting liquid absorbing member | Before contacting recording medium |
| Comparative Example 9 | 25 | Presence | — | | 1000 | 100 | 100 | 7.4 | 7.2 |
| (Comparative Example 5) | | | 200 | 50 | 200 | 50 | | 7.4 | 7.4 |

Similar to Comparative Example 5, in Comparative Example 9, the complex elastic modulus (Pa) of the second intermediate image (before contacting the liquid absorbing member) was 4.0 or more in the common logarithm. In addition, similar to Comparative Example 5, in Comparative Example 9, the complex elastic modulus of the third intermediate image (before contacting the recording medium) was 7.0 or more. Compared to Example 3, in Example 25, the complex elastic moduli of the second and third intermediate images decreased, whereas compared to Comparative Example 5, in Comparative Example 9, the complex elastic moduli of the second and third intermediate images were hardly changed.

Examples 27 and 28

In these examples, the image formation and the measurement of the complex elastic modulus were performed in the same manner as Example 4 except that the drying was promoted by blowing air of normal temperature and the liquid removal rate was adjusted as shown in the table while the intermediate image came into contact with the liquid absorbing member and then came into contact with the recording medium. The results are shown in Table 8. In order to make the comparison easier to understand, Table 8 shows the liquid removal rate and the measurement results of Example 3. The liquid removal rate was calculated by measuring the weight of the intermediate image.

TABLE 8

| | | | | $\log_{10}(G^*(Pa))$ | |
|---|---|---|---|---|---|
| | Ink | Reaction liquid | Liquid removal rate (%) | Before contacting liquid absorbing member | Before contacting recording medium |
| Example 27 | 4 | Presence | 90 | 6.0 | 5.9 |
| Example 28 | | | 97 | | 6.6 |
| (Example 4) | | | 70 | | 5.8 |

In Examples 27 and 28, the complex elastic modulus of the second intermediate image (before contacting the liquid absorbing member) was 4.0 or more in the common logarithm. In addition, the complex elastic modulus of the third intermediate image (before contacting with the recording medium) was 7.0 or less. Similar to Example 4, in Example 27, the complex elastic modulus of the third intermediate image (before contacting the recording medium) was smaller than the complex elastic modulus of the second intermediate image (before contacting the liquid absorbing member). However, in Example 28, the complex elastic modulus of the third complex elastic modulus (before contacting the recording medium) was larger than the complex elastic modulus of the second intermediate image (before contacting the liquid absorbing member).

Comparative Examples 10 and 11

The ink to be applied was changed to ink 14, and the irradiation conditions with ultraviolet rays were changed as shown in Table 9. Except for this, the image formation and the measurement of complex elastic modulus were performed in the same manner as in Examples 1 to 20.

TABLE 9

| | Ink | Reaction liquid | Irradiation condition of ultraviolet ray: Upstream irradiating device: Peak illuminance (mW/cm$^2$) | Upstream irradiating device: Integrated light quantity (mJ/cm$^2$) | Downstream irradiating device: Peak illuminance (mW/cm$^2$) | Downstream irradiating device: Integrated light quantity (mJ/cm$^2$) | Total: Integrated light quantity (mJ/cm$^2$) | $\log_{10}$(G*(Pa)): Before contacting liquid absorbing member | $\log_{10}$(G*(Pa)): Before contacting recording medium |
|---|---|---|---|---|---|---|---|---|---|
| Comparative Example 10 | 29 | Presence | 1000 | 200 | 1000 | 200 | 400 | 7.3 | 7.7 |
| Comparative Example 11 | | | | 50 | | 50 | 100 | 6.7 | 7.1 |

Comparative Example 10 showed the complete curing, and Comparative Example 11 showed the semi-cured state before reaching the complete curing. In either case, the complex elastic modulus (Pa) before contact with the liquid absorbing member was 4.0 or more in the common logarithm, but was 7.0 or more before contact with the recording medium.

Example 29

In this example, the image formation and the measurement of the complex elastic modulus were performed in the same manner as in Example 5 except that glutaric acid, which is an organic acid contained in the reaction liquid was changed to citric acid. The results are shown in Table 10.

TABLE 10

| | Ink | Reaction liquid | $\log_{10}$(G*(Pa)): Before contacting liquid absorbing member | $\log_{10}$(G*(Pa)): Before contacting recording medium |
|---|---|---|---|---|
| Example 29 | 5 | Presence (Containing citric acid) | 6 | 5.5 |

The image formation was performed based on the above examples and comparative examples, and the color migration and the transferability to the liquid absorbing member were evaluated by the following methods. For the measurement of optical density (also referred to as OD), a spectral reflection densitometer 504 manufactured by X-rite Inc. was used, and the density of magenta was measured. Note that the optical density of the liquid absorbing member or the transfer body as a base was measured in advance, and the value was subtracted.

(Color Migration to Liquid Absorbing Member)

After the image formation, the optical density of the liquid absorbing member was measured, and the evaluation was performed according to the following determination criteria based on the measured value.

A: OD is 0.05 or less.

B: OD is greater than 0.05 and is 0.20 or less.

C: OD is greater than 0.20.

(Transferability)

After the image formation, the optical density of the transfer body was measured, and the evaluation was performed according to the following determination criteria based on the measured value. The optical density of the transfer body corresponds to the amount remaining without being transferred, and the fact that this value is small indicates that transferability is good.

A: OD is 0.05 or less.

B: OD is greater than 0.05 and is 0.20 or less.

C: OD is greater than 0.20.

The evaluation results are shown in Tables 11 to 17. When the complex elastic modulus (Pa) of the second intermediate image (before contacting the liquid absorbing member) was 4.0 or more in the common logarithm, the color migration to the liquid absorbing member was reduced. Further, when the complex elastic modulus (Pa) of the third intermediate image (before contacting the recording medium) was 7.0 or less in the common logarithm, the transfer was performed satisfactorily.

Furthermore, when the ink contained at least both a monofunctional polymerizable component and a polyfunctional polymerizable component, the color migration to the liquid absorbing member was further reduced and the transferability was further improved.

Further, when the ink satisfied General Formula (I), the color migration to the liquid absorbing member was further reduced, and the transferability was further improved.

Furthermore, when the UV irradiation was performed by the plurality of irradiating devices having different illuminance, and the illuminance of the upstream irradiating device was smaller than the illuminance of the downstream irradiating device, the color migration to the liquid absorbing member was further reduced.

Furthermore, when the complex elastic modulus of the third intermediate image (before contacting the recording medium) was smaller than that of the second intermediate image (before contacting the liquid absorbing member) by removing the liquid component, the transfer was better made.

TABLE 11

| | Color migration to liquid absorbing member: OD on liquid absorbing member | Color migration to liquid absorbing member: Evaluation | Transferability: OD on transfer body | Transferability: Evaluation |
|---|---|---|---|---|
| Example 1 | 0.11 | B | 0.03 | A |
| Example 2 | 0.09 | B | 0.04 | A |
| Example 3 | 0.05 | A | 0.02 | A |
| Example 4 | 0.03 | A | 0.03 | A |
| Example 5 | 0.03 | A | 0.07 | B |
| Example 6 | 0.01 | A | 0.1 | B |
| Example 7 | 0.16 | B | 0.14 | B |
| Example 8 | 0.1 | B | 0.06 | B |
| Example 9 | 0.14 | B | 0.1 | B |
| Example 10 | 0.11 | B | 0.19 | B |

TABLE 11-continued

| | Color migration to liquid absorbing member | | Transferability | |
|---|---|---|---|---|
| | OD on liquid absorbing member | Evaluation | OD on transfer body | Evaluation |
| Example 11 | 0.03 | A | 0.01 | A |
| Example 12 | 0.1 | B | 0.03 | A |
| Example 13 | 0.05 | A | 0.01 | A |
| Example 14 | 0.05 | A | 0.02 | A |
| Example 15 | 0.02 | A | 0.05 | A |
| Example 16 | 0.03 | A | 0.18 | B |
| Example 17 | 0.05 | A | 0.03 | A |
| Example 18 | 0.04 | A | 0.04 | A |
| Example 19 | 0.02 | A | 0.19 | B |
| Example 20 | 0.17 | B | 0.18 | B |
| Example 21 | 0.11 | B | 0.04 | A |
| Example 22 | 0.05 | A | 0.05 | A |
| Example 23 | 0.03 | A | 0.05 | A |
| Example 24 | 0.02 | A | 0.08 | B |

TABLE 12

| | Color migration to liquid absorbing member | | Transferability | |
|---|---|---|---|---|
| | OD on liquid absorbing member | Evaluation | OD on transfer body | Evaluation |
| Comparative Example 1 | 1.36 | C | — (No measurement) | |
| Comparative Example 2 | 1.30 | C | | |
| Comparative Example 3 | 1.45 | C | | |
| Comparative Example 4 | 0.02 | A | 0.7 | C |
| Comparative Example 5 | 0.01 | A | 0.36 | C |
| Comparative Example 6 | 0.50 | C | — (No measurement) | |
| Comparative Example 7 | 0.05 | A | 1.3 | C |
| Comparative Example 8 | 1.2 | C | — (No measurement) | |

TABLE 13

| | Color migration to liquid absorbing member | | Transferability | |
|---|---|---|---|---|
| | OD on liquid absorbing member | Evaluation | OD on transfer body | Evaluation |
| Example 25 | 0.09 | B | 0.04 | A |
| Example 26 | 0.05 | A | 0.04 | A |
| (Example 3) | 0.05 | A | 0.02 | A |

TABLE 14

| | Color migration to liquid absorbing member | | Transferability | |
|---|---|---|---|---|
| | OD on liquid absorbing member | Evaluation | OD on transfer body | Evaluation |
| Comparative Example 9 | 0.01 | A | 0.32 | C |
| (Comparative Example 5) | 0.01 | A | 0.36 | C |

TABLE 15

| | Color migration to liquid absorbing member | | Transferability | |
|---|---|---|---|---|
| | OD on liquid absorbing member | Evaluation | OD on transfer body | Evaluation |
| Example 27 | 0.03 | A | 0.03 | A |
| Example 28 | | | 0.09 | B |
| (Example 4) | | | 0.03 | A |

TABLE 16

| | Color migration to liquid absorbing member | | Transferability | |
|---|---|---|---|---|
| | OD on liquid absorbing member | Evaluation | OD on transfer body | Evaluation |
| Comparative Example 10 | 0.04 | A | 1.18 | C |
| Comparative Example 11 | 0.04 | A | 1.10 | C |

TABLE 17

| | Color migration to liquid absorbing member | | Transferability | |
|---|---|---|---|---|
| | OD on liquid absorbing member | Evaluation | OD on transfer body | Evaluation |
| Example 29 | 0.03 | A | 0.01 | A |

In the present invention, the complex elastic moduli of the second and third intermediate images are adjusted to a specific range. As a result, it is possible to provide the ink jet image forming method and the ink jet image forming apparatus capable of satisfactorily transferring the intermediate image to the recording medium while reducing the shift of the intermediate image to the liquid absorbing member.

According to the present invention, it is possible to provide the ink jet image forming method and the ink jet image forming apparatus capable of satisfactorily transferring the intermediate image to the recording medium while reducing the shift of the intermediate image to the liquid absorbing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet image forming method comprising:

a first step of forming a first intermediate image by applying an ink containing at least water and a component that is cured by irradiation with active energy rays to a transfer body;

a second step of forming a second intermediate image by irradiating the first intermediate image with active energy rays;

a third step of forming a third intermediate image by bringing a liquid absorbing member into contact with the second intermediate image to remove at least a part of liquid components contained in the second intermediate image; and a fourth step of forming an image on a recording medium by transferring the third intermediate image from the transfer body to the recording medium, wherein a complex elastic modulus (Pa) of the second intermediate image is 4.0 or more in a common logarithm, and a complex elastic modulus (Pa) of the third intermediate image is 7.0 or less in a common logarithm.

2. The ink jet image forming method according to claim 1, wherein the ink contains both a monofunctional polymerizable component and a polyfunctional polymerizable component.

3. The ink jet image forming method according to claim 1, wherein the component that is cured by irradiation with the active energy rays is a water-based ink that contains at least one of monofunctional component or difunctional component as a component that imparts Flexibility, and at least one polyfunctional component that is difunctional or higher as a component that imparts a network structure, and the component that is cured by the active energy rays satisfies a relationship represented by general formula (I):

$$-0.30<\log_{10}((\text{total number of functional groups of monofunctional component}+\text{total number of functional groups of difunctional component})/\text{total number of functional groups of polyfunctional component})<1.80.$$

4. The ink jet image forming method according to claim 1, wherein at least one said component that is cured by irradiation with the active energy rays is water-soluble.

5. The ink jet image forming method according to claim 4, wherein the at least one said component is a component that imparts the flexibility.

6. The ink jet image forming method according to claim 4, wherein the at least said component contains an acrylamide structure or a methacrylamide structure.

7. The ink jet image forming method according to claim 1, wherein the second step is performed by a plurality of irradiating devices having different illuminances of active energy rays, and an illuminance of an upstream irradiating device is smaller than an illuminance of a downstream irradiating device.

8. The ink jet image forming method according to claim 1, wherein the complex elastic modulus of the third intermediate image is smaller than the complex elastic modulus of the second intermediate image.

9. An ink jet image forming apparatus comprising:

a transfer body;

an ink applying device that forms a first intermediate image by applying an ink containing at least water and a component that is cured by irradiation with active energy rays to the transfer body;

an active energy ray irradiating device that forms a second intermediate image by irradiating the first intermediate image with active energy rays;

a liquid absorbing device that forms a third intermediate image by bringing a liquid absorbing member into contact with the second intermediate image to remove at least a part of liquid components contained in the second intermediate image; and a transfer device that forms an image on a recording medium by transferring the third intermediate image from the transfer body to the recording medium, wherein a complex elastic modulus (Pa) of the second intermediate image is 4.0 or more in a common logarithm, and a complex elastic modulus (Pa) of the third intermediate image is 7.0 or less in a common logarithm.

10. The ink jet image forming apparatus according to claim 9, wherein the ink applying device contains an ink containing both a monofunctional polymerizable component and a polyfunctional polymerizable component.

11. The ink jet image forming apparatus according to claim 9, wherein the ink applying device contains a water-based ink in which the component that is cured by irradiation with the active energy rays contains at least one of monofunctional component or difunctional component as a component that imparts flexibility, and at least one polyfunctional component that is difunctional or higher as a component that imparts a network structure, and satisfies a relationship represented by general formula (I):

$$-0.30<\log_{10}((\text{total number of functional groups of monofunctional component}+\text{total number of functional groups of difunctional component})/\text{total number of functional groups of polyfunctional component})<1.80.$$

12. The ink jet image forming apparatus according to claim 9, wherein at least one said component that is cured by irradiation with the active energy rays is water-soluble.

13. The ink jet image forming apparatus according to claim 12, wherein the at least one said component is a component that imparts flexibility.

14. The ink jet image forming apparatus according to claim 12, wherein the at least one said component contains an acrylamide structure or a methacrylamide structure.

15. The ink jet image forming apparatus according to claim 9, further comprising a plurality of irradiating devices having different illuminances of active energy rays, wherein an illuminance of an upstream irradiating device is smaller than an illuminance of a downstream irradiating device.

16. The ink jet image forming apparatus according to claim 9, wherein the complex elastic modulus of the third intermediate image is smaller than the complex elastic modulus of the second intermediate image.

* * * * *